US010857537B2

(12) United States Patent
Norton

(10) Patent No.: US 10,857,537 B2
(45) Date of Patent: Dec. 8, 2020

(54) BALANCED AC MODULATION FOR DRIVING DROPLET OPERATIONS ELECTRODES

(71) Applicant: ILLUMINA, INC., San Diego, CA (US)

(72) Inventor: Kirkpatrick W. Norton, San Diego, CA (US)

(73) Assignee: ILLUMINA, INC., San Diego, CA (US)

( * ) Notice: Subject to any disclaimer, the term of this patent is extended or adjusted under 35 U.S.C. 154(b) by 298 days.

(21) Appl. No.: 15/739,678

(22) PCT Filed: Jul. 5, 2016

(86) PCT No.: PCT/US2016/040966
§ 371 (c)(1),
(2) Date: Dec. 22, 2017

(87) PCT Pub. No.: WO2017/007757
PCT Pub. Date: Jan. 12, 2017

(65) Prior Publication Data

US 2018/0185848 A1 Jul. 5, 2018

Related U.S. Application Data

(60) Provisional application No. 62/254,893, filed on Nov. 13, 2015, provisional application No. 62/249,500,
(Continued)

(51) Int. Cl.
*B01L 3/00* (2006.01)

(52) U.S. Cl.
CPC ..... *B01L 3/502792* (2013.01); *B01L 3/50273* (2013.01); *B01L 2200/143* (2013.01); *B01L 2400/0427* (2013.01)

(58) Field of Classification Search
CPC ..... B01L 3/502; B01L 3/502784; B01L 3/502792; B01L 3/50273; B01L 2400/0427; G01N 13/00
See application file for complete search history.

(56) References Cited

U.S. PATENT DOCUMENTS 6,565,727 B1 5/2003 Shenderov et al.
6,773,566 B2 8/2004 Shenderov et al.
(Continued)

FOREIGN PATENT DOCUMENTS

EP 2085758 8/2009
EP 2514529 10/2012
(Continued)

OTHER PUBLICATIONS

Bentley, et al., "Accurate whole human genome sequencing using reversible terminator chemistry", Nature, vol. 456, Nov. 6, 2008, 53-59.
(Continued)

*Primary Examiner* — Gurpreet Kaur
(74) *Attorney, Agent, or Firm* — Illumina, Inc.

(57) ABSTRACT

A droplet actuator device for conducting droplet operations is provided that comprises a substrate defines a device channel to conduct droplet operations. Electrodes are arranged proximate to the substrate. A drive circuit is connected to the electrodes. The drive circuit generates an electrode drive signal to drive the droplet operations based on a reference waveform. The electrode drive signal is partitioned into an AC modulated drive cycle formed of sub-cycles. The electrode drive signal switches, during the sub-cycle, between at least first and second states where a degree of modulation with respect to the reference waveform forms a balanced modulation pattern.

6 Claims, 11 Drawing Sheets

Related U.S. Application Data filed on Nov. 2, 2015, provisional application No. 62/199,447, filed on Jul. 31, 2015, provisional application No. 62/188,825, filed on Jul. 6, 2015.

(56) References Cited

U.S. PATENT DOCUMENTS

| | | | |
|---|---|---|---|
| 6,911,132 | B2 | 6/2005 | Pamula et al. |
| 6,977,033 | B2 | 12/2005 | Becker et al. |
| 7,052,244 | B2 | 5/2006 | Fouillet et al. |
| 7,057,026 | B2 | 6/2006 | Barnes et al. |
| 7,163,612 | B2 | 1/2007 | Sterling et al. |
| 7,211,414 | B2 | 5/2007 | Hardin S et al. |
| 7,315,019 | B2 | 1/2008 | Turner et al. |
| 7,329,492 | B2 | 2/2008 | Hardin et al. |
| 7,329,860 | B2 | 2/2008 | Feng et al. |
| 7,405,281 | B2 | 7/2008 | Xu et al. |
| 7,547,380 | B2 | 6/2009 | Velev |
| 7,641,779 | B2 | 1/2010 | Becker et al. |
| 7,727,466 | B2 | 6/2010 | Meathrel et al. |
| 8,039,817 | B2 | 10/2011 | Feng et al. |
| 8,241,573 | B2 | 8/2012 | Banerjee et al. |
| 2003/0205632 | A1 | 11/2003 | Kim et al. |
| 2005/0179746 | A1 | 8/2005 | Roux et al. |
| 2006/0039823 | A1 | 2/2006 | Yamakawa et al. |
| 2006/0164490 | A1 | 7/2006 | Kim et al. |
| 2006/0194331 | A1 | 8/2006 | Pamula et al. |
| 2007/0023292 | A1 | 2/2007 | Kim et al. |
| 2008/0108082 | A1 | 5/2008 | Rank et al. |
| 2008/0124252 | A1 | 5/2008 | Marchand et al. |
| 2009/0192044 | A1 | 7/2009 | Fouillet |
| 2009/0272914 | A1 | 11/2009 | Feng et al. |
| 2009/0283407 | A1 | 11/2009 | Shah et al. |
| 2009/0321262 | A1 | 12/2009 | Adachi et al. |
| 2010/0096266 | A1 | 4/2010 | Kim et al. |
| 2010/0194408 | A1 | 8/2010 | Sturmer et al. |
| 2011/0048951 | A1 | 3/2011 | Wu |
| 2012/0268804 | A1* | 10/2012 | Hadwen ..... G02B 26/005 359/290 |
| 2012/0270305 | A1 | 10/2012 | Williamson et al. |
| 2013/0215095 | A1 | 8/2013 | Shin et al. |

FOREIGN PATENT DOCUMENTS

| | | |
|---|---|---|
| EP | 2759342 | 7/2014 |
| WO | 2002/080822 | 10/2002 |
| WO | 2007/120241 | 10/2007 |
| WO | 2008/042067 | 4/2008 |
| WO | 2008/101194 | 8/2008 |
| WO | 2011/002957 | 1/2011 |
| WO | 2013/117595 | 8/2013 |
| WO | 2013/131962 | 9/2013 |

OTHER PUBLICATIONS

Dhindsa, et al., "Virtual Electrowetting Channels: Electronic Liquid Transport with Continuous Channel Functionality", Lab on a Chip, vol. 10, 2010, 832-836.

PCT/US2016/040966, International Search Report and Written Opinion dated Oct. 6, 2016, 11 pages.

* cited by examiner

BALANCED AC MODULATION FOR DRIVING DROPLET OPERATIONS ELECTRODES

CROSS-REFERENCE TO RELATED APPLICATION

The present application is a U.S. National Stage Application of and claims priority to International Patent Application No. PCT/US2016/040966, filed on Jul. 5, 2016, and entitled "BALANCED AC MODULATION FOR DRIVING DROPLET OPERATIONS ELECTRODES," which claims the benefit of U.S. Provisional Application No. 62/188,825 which was filed on Jul. 6, 2015, U.S. Provisional Application No. 62/199,447 which was filed on Jul. 31, 2015, U.S. Provisional Application No. 62/249,500 which was filed on Nov. 2, 2015 and U.S. Provisional Application No. 62/254,893 which was filed on Nov. 13, 2015. Each of the above applications is incorporated herein by reference in its entirety.

BACKGROUND

A droplet actuator typically includes one or more substrates configured to form a surface or gap for conducting droplet operations. The one or more substrates establish a droplet operations surface or gap for conducting droplet operations and may also include electrodes arranged to conduct the droplet operations. The droplet operations substrate or the gap between the substrates may be coated or filled with a filler fluid that is immiscible with the liquid that forms the droplets.

In digital fluidics, the droplet operations electrodes are driven by an AC voltage. However, in standard AC drive schemes, the electrodes are driven using a common supply voltage. Consequently, it may be difficult to provide individual control of the electrodes. Therefore, new approaches are needed for driving the droplet operations electrodes in a droplet actuator.

Definitions

As used herein, the following terms have the meanings indicated.

"Activate," with reference to one or more electrodes, means affecting a change in the electrical state of the one or more electrodes which, in the presence of a droplet, results in a droplet operation. Activation of an electrode can be accomplished using alternating current (AC) or direct current (DC). Any suitable voltage may be used. For example, an electrode may be activated using a voltage which is greater than about 150 V, or greater than about 200 V, or greater than about 250 V, or from about 275 V to about 1000 V, or about 300 V. Where an AC signal is used, any suitable frequency may be employed. For example, an electrode may be activated using an AC signal having a frequency from about 1 Hz to about 10 MHz, or from about 10 Hz to about 60 Hz, or from about 20 Hz to about 40 Hz, or about 30 Hz.

"Droplet" means a volume of liquid on a droplet actuator. Typically, a droplet is at least partially bounded by a filler fluid. For example, a droplet may be completely surrounded by a filler fluid or may be bounded by filler fluid and one or more surfaces of the droplet actuator. As another example, a droplet may be bounded by filler fluid, one or more surfaces of the droplet actuator, and/or the atmosphere. As yet another example, a droplet may be bounded by filler fluid and the atmosphere. Droplets may, for example, be aqueous or non-aqueous or may be mixtures or emulsions including aqueous and non-aqueous components. Droplets may take a wide variety of shapes; nonlimiting examples include generally disc shaped, slug shaped, truncated sphere, ellipsoid, spherical, partially compressed sphere, hemispherical, ovoid, cylindrical, combinations of such shapes, and various shapes formed during droplet operations, such as merging or splitting or formed as a result of contact of such shapes with one or more surfaces of a droplet actuator. For examples of droplet fluids that may be subjected to droplet operations using the approach of the present disclosure, see Eckhardt et al., International Patent Pub. No. WO/2007/120241, entitled, "Droplet-Based Biochemistry," published on Oct. 25, 2007, the entire disclosure of which is incorporated herein by reference.

In various embodiments, a droplet may include a biological sample, such as whole blood, lymphatic fluid, serum, plasma, sweat, tear, saliva, sputum, cerebrospinal fluid, amniotic fluid, seminal fluid, vaginal excretion, serous fluid, synovial fluid, pericardial fluid, peritoneal fluid, pleural fluid, transudates, exudates, cystic fluid, bile, urine, gastric fluid, intestinal fluid, fecal samples, liquids containing single or multiple cells, liquids containing organelles, fluidized tissues, fluidized organisms, liquids containing multi-celled organisms, biological swabs and biological washes. Moreover, a droplet may include a reagent, such as water, deionized water, saline solutions, acidic solutions, basic solutions, detergent solutions and/or buffers. A droplet can include nucleic acids, such as DNA, genomic DNA, RNA, mRNA or analogs thereof; nucleotides such as deoxyribonucleotides, ribonucleotides or analogs thereof such as analogs having terminator moieties such as those described in Bentley et al., *Nature* 456:53-59 (2008); Gormley et al., International Patent Pub. No. WO/2013/131962, entitled, "Improved Methods of Nucleic Acid Sequencing," published on Sep. 12, 2013; Barnes et al., U.S. Pat. No. 7,057,026, entitled "Labelled Nucleotides," issued on Jun. 6, 2006; Kozlov et al., International Patent Pub. No. WO/2008/042067, entitled, "Compositions and Methods for Nucleotide Sequencing," published on Apr. 10, 2008; Rigatti et al., International Patent Pub. No. WO/2013/117595, entitled, "Targeted Enrichment and Amplification of Nucleic Acids on a Support," published on Aug. 15, 2013; Hardin et al., U.S. Pat. No. 7,329,492, entitled "Methods for Real-Time Single Molecule Sequence Fetermination," issued on Feb. 12, 2008; Hardin et al., U.S. Pat. No. 7,211,414, entitled "Enzymatic Nucleic Acid Synthesis: Compositions and Methods for Altering Monomer Incorporation Fidelity," issued on May 1, 2007; Turner et al., U.S. Pat. No. 7,315,019, entitled "Arrays of Optical Confinements and Uses Thereof," issued on Jan. 1, 2008; Xu et al., U.S. Pat. No. 7,405,281, entitled "Fluorescent Nucleotide Analogs and Uses Therefor," issued on Jul. 29, 2008; and Ranket al., U.S. Patent Pub. No. 20080108082, entitled "Polymerase Enzymes and Reagents for Enhanced Nucleic Acid Sequencing," published on May 8, 2008, the entire disclosures of which are incorporated herein by reference; enzymes such as polymerases, ligases, recombinases, or transposases; binding partners such as antibodies, epitopes, streptavidin, avidin, biotin, lectins or carbohydrates; or other biochemically active molecules. Other examples of droplet contents include reagents, such as a reagent for a biochemical protocol, such as a nucleic acid amplification protocol, an affinity-based assay protocol, an enzymatic assay protocol, a sequencing protocol, and/or a protocol for analyses of biological fluids. A droplet may include one or more beads.

"Droplet Actuator" means a device for manipulating droplets. For examples of droplet actuators, see Pamula et al., U.S. Pat. No. 6,911,132, entitled "Apparatus for Manipulating Droplets by Electrowetting-Based Techniques," issued on Jun. 28, 2005; Pamula et al., U.S. Patent Pub. No. 20060194331, entitled "Apparatuses and Methods for Manipulating Droplets on a Printed Circuit Board," published on Aug. 31, 2006; Pollack et al., International Patent Pub. No. WO/2007/120241, entitled "Droplet-Based Biochemistry," published on Oct. 25, 2007; Shenderov, U.S. Pat. No. 6,773,566, entitled "Electrostatic Actuators for Microfluidics and Methods for Using Same," issued on Aug. 10, 2004; Shenderov, U.S. Pat. No. 6,565,727, entitled "Actuators for Microfluidics Without Moving Parts," issued on May 20, 2003; Kim et al., U.S. Patent Pub. No. 20030205632, entitled "Electrowetting-driven Micropumping," published on Nov. 6, 2003; Kim et al., U.S. Patent Pub. No. 20060164490, entitled "Method and Apparatus for Promoting the Complete Transfer of Liquid Drops from a Nozzle," published on Jul. 27, 2006; Kim et al., U.S. Patent Pub. No. 20070023292, entitled "Small Object Moving on Printed Circuit Board," published on Feb. 1, 2007; Shah et al., U.S. Patent Pub. No. 20090283407, entitled "Method for Using Magnetic Particles in Droplet Microfluidics," published on Nov. 19, 2009; Kim et al., U.S. Patent Pub. No. 20100096266, entitled "Method and Apparatus for Real-time Feedback Control of Electrical Manipulation of Droplets on Chip," published on Apr. 22, 2010; Velev, U.S. Pat. No. 7,547,380, entitled "Droplet Transportation Devices and Methods Having a Fluid Surface," issued on Jun. 16, 2009; Sterling et al., U.S. Pat. No. 7,163,612, entitled "Method, Apparatus and Article for Microfluidic Control via Electrowetting, for Chemical, Biochemical and Biological Assays and the Like," issued on Jan. 16, 2007; Becker et al., U.S. Pat. No. 7,641,779, entitled "Method and Apparatus for Programmable Fluidic Processing," issued on Jan. 5, 2010; Becker et al., U.S. Pat. No. 6,977,033, entitled "Method and Apparatus for Programmable Fluidic Processing," issued on Dec. 20, 2005; Decre et al., U.S. Pat. No. 7,328,979, entitled "System for Manipulation of a Body of Fluid," issued on Feb. 12, 2008; Yamakawa et al., U.S. Patent Pub. No. 20060039823, entitled "Chemical Analysis Apparatus," published on Feb. 23, 2006; Wu, U.S. Patent Pub. No. 20110048951, entitled "Digital Microfluidics Based Apparatus for Heat-exchanging Chemical Processes," published on Mar. 3, 2011; Fouillet et al., U.S. Patent Pub. No. 20090192044, entitled "Electrode Addressing Method," published on Jul. 30, 2009; Fouillet et al., U.S. Pat. No. 7,052,244, entitled "Device for Displacement of Small Liquid Volumes Along a Micro-catenary Line by Electrostatic Forces," issued on May 30, 2006; Marchand et al., U.S. Patent Pub. No. 20080124252, entitled "Droplet Microreactor," published on May 29, 2008; Adachi et al., U.S. Patent Pub. No. 20090321262, entitled "Liquid Transfer Device," published on Dec. 31, 2009; Roux et al., U.S. Patent Pub. No. 20050179746, entitled "Device for Controlling the Displacement of a Drop Between Two or Several Solid Substrates," published on Aug. 18, 2005; and Dhindsa et al., "Virtual Electrowetting Channels: Electronic Liquid Transport with Continuous Channel Functionality," Lab Chip, 10:832-836 (2010), the entire disclosures of which are incorporated herein by reference.

Certain droplet actuators will include one or more substrates arranged with a droplet operations gap there between and electrodes associated with (e.g., layered on, attached to, and/or embedded in) the one or more substrates and arranged to conduct one or more droplet operations. For example, certain droplet actuators will include a base (or bottom) substrate, droplet operations electrodes associated with the substrate, one or more dielectric layers atop the substrate and/or electrodes, and optionally one or more hydrophobic layers atop the substrate, dielectric layers and/or the electrodes forming a droplet operations surface. A top substrate may also be provided, which is separated from the droplet operations surface by a gap, commonly referred to as a droplet operations gap. Various electrode arrangements on the top and/or bottom substrates are discussed in the above-referenced patents and applications and certain novel electrode arrangements are discussed in the description of the present disclosure.

Optionally, the droplet actuator device may be constructed from various substrate architectures such as coplanar architectures, bi-planar architectures and the like. An example of a coplanar architecture is when the droplet actuator device is constructed using a single substrate with a top surface and a bottom surface, where the single substrate includes a device channel. Optionally, the droplet actuator device may be formed with an open sided substrate thereby providing the device channel uncovered. One example of a structure that may afford an open sided substrate may represent a printed circuit board, into which open sided device channels are formed.

During droplet operations it is preferred that droplets remain in continuous contact or frequent contact with a ground or reference electrode such that the droplets are driven to a reference voltage or reference waveform. A ground or reference electrode may be associated with the top substrate facing the gap, the bottom substrate facing the gap, in the gap. Where electrodes are provided on both substrates, electrical contacts for coupling the electrodes to a droplet actuator instrument for controlling or monitoring the electrodes may be associated with one or both plates. In some cases, electrodes on one substrate are electrically coupled to the other substrate so that only one substrate is in contact with the droplet actuator. In one embodiment, a conductive material (e.g., an epoxy, such as MASTER BOND™ Polymer System EP79, available from Master Bond, Inc., Hackensack, N.J.) provides the electrical connection between electrodes on one substrate and electrical paths on the other substrates, e.g., a ground electrode on a top substrate may be coupled to an electrical path on a bottom substrate by such a conductive material. Where multiple substrates are used, a spacer may be provided between the substrates to determine the height of the gap therebetween and define on-actuator dispensing reservoirs. The spacer height may, for example, be at least about 5 μm, 100 μm, 200 μm, 250 μm, 275 μm or more. Alternatively or additionally the spacer height may be at most about 600 μm, 400 μm, 350 μm, 300 μm, or less. The spacer may, for example, be formed of a layer of projections form the top or bottom substrates, and/or a material inserted between the top and bottom substrates. One or more openings may be provided in the one or more substrates for forming a fluid path through which liquid may be delivered into the droplet operations gap. The one or more openings may in some cases be aligned for interaction with one or more electrodes, e.g., aligned such that liquid flowed through the opening will come into sufficient proximity with one or more droplet operations electrodes to permit a droplet operation to be effected by the droplet operations electrodes using the liquid. The base (or bottom) and top substrates may in some cases be formed as one integral component. One or more reference electrodes may be provided on the base (or bottom) and/or top substrates and/or in the gap. Examples of reference electrode arrangements are provided in the above referenced patents and patent applications.

In various embodiments, the manipulation of droplets by a droplet actuator may be electrode mediated, e.g., electrowetting mediated or dielectrophoresis mediated or Coulombic force mediated. Examples of other techniques for controlling droplet operations that may be used in the droplet actuators of the present disclosure include using devices that induce hydrodynamic fluidic pressure, such as those that operate on the basis of mechanical principles (e.g. external syringe pumps, pneumatic membrane pumps, vibrating membrane pumps, vacuum devices, centrifugal forces, piezoelectric/ultrasonic pumps and acoustic forces); electrical or magnetic principles (e.g. electroosmotic flow, electrokinetic pumps, ferrofluidic plugs, electrohydrodynamic pumps, attraction or repulsion using magnetic forces and magnetohydrodynamic pumps); thermodynamic principles (e.g. gas bubble generation/phase-change-induced volume expansion); other kinds of surface-wetting principles (e.g. electrowetting, and optoelectrowetting, as well as chemically, thermally, structurally and radioactively induced surface-tension gradients); gravity; surface tension (e.g., capillary action); electrostatic forces (e.g., electroosmotic flow); centrifugal flow (substrate disposed on a compact disc and rotated); magnetic forces (e.g., oscillating ions causes flow); magnetohydrodynamic forces; and vacuum or pressure differential. In certain embodiments, combinations of two or more of the foregoing techniques may be employed to conduct a droplet operation in a droplet actuator of the present disclosure. Similarly, one or more of the foregoing may be used to deliver liquid into a droplet operations gap, e.g., from a reservoir in another device or from an external reservoir of the droplet actuator (e.g., a reservoir associated with a droplet actuator substrate and a flow path from the reservoir into the droplet operations gap). Droplet operations surfaces of certain droplet actuators of the present disclosure may be made from hydrophobic materials or may be coated or treated to make them hydrophobic. For example, in some cases some portion or all of the droplet operations surfaces may be derivatized with low surface-energy materials or chemistries, e.g., by deposition or using in situ synthesis using compounds such as poly- or per-fluorinated compounds in solution or polymerizable monomers. Examples include TEFLON® AF (available from DuPont, Wilmington, Del.), members of the cytop family of materials, coatings in the FLUOROPEL® family of hydrophobic and superhydrophobic coatings (available from Cytonix Corporation, Beltsville, Md.), silane coatings, fluorosilane coatings, hydrophobic phosphonate derivatives (e.g., those sold by Aculon, Inc), and NOVEC™ electronic coatings (available from 3M Company, St. Paul, Minn.), other fluorinated monomers for plasma-enhanced chemical vapor deposition (PECVD), and organosiloxane (e.g., SiOC) for PECVD.

In some cases, the droplet operations surface may include a hydrophobic coating having a thickness ranging from about 10 nm to about 1,000 nm. Moreover, in some embodiments, the top substrate of the droplet actuator includes an electrically conducting organic polymer, which is then coated with a hydrophobic coating or otherwise treated to make the droplet operations surface hydrophobic. For example, the electrically conducting organic polymer that is deposited onto a plastic substrate may be poly(3,4-ethylenedioxythiophene) poly(styrenesulfonate) (PEDOT:PSS). Other examples of electrically conducting organic polymers and alternative conductive layers are described in Pollack et al., International Patent Pub. No. WO/2011/002957, entitled "Droplet Actuator Devices and Methods," published on Jan. 6, 2011, the entire disclosure of which is incorporated herein by reference. One or both substrates may be fabricated using a printed circuit board (PCB), glass, indium tin oxide (ITO)-coated glass, and/or semiconductor materials as the substrate. When the substrate is ITO-coated glass, the ITO coating is preferably a thickness of at least about 20 nm, 50 nm, 75 nm, 100 nm or more. Alternatively or additionally the thickness can be at most about 200 nm, 150 nm, 125 nm or less. In some cases, the top and/or bottom substrate includes a PCB substrate that is coated with a dielectric, such as a polyimide dielectric, which may in some cases also be coated or otherwise treated to make the droplet operations surface hydrophobic.

When the substrate includes a PCB, the following materials are examples of suitable materials: MITSUI™ BN-300 (available from MITSUI Chemicals America, Inc., San Jose Calif.); ARLON™ 11N (available from Arlon, Inc, Santa Ana, Calif.); NELCO® N4000-6 and N5000-30/32 (available from Park Electrochemical Corp., Melville, N.Y.); ISOLA™ FR406 (available from Isola Group, Chandler, Ariz.), especially IS620; fluoropolymer family (suitable for fluorescence detection since it has low background fluorescence); polyimide family; polyester; polyethylene naphthalate; polycarbonate; polyetheretherketone; liquid crystal polymer; cyclo-olefin copolymer (COC); cyclo-olefin polymer (COP); aramid; THERMOUNT® nonwoven aramid reinforcement (available from DuPont, Wilmington, Del.); NOMEX® brand fiber (available from DuPont, Wilmington, Del.); and paper. Various materials are also suitable for use as the dielectric component of the substrate. Examples include: vapor deposited dielectric, such as PARYLENE™ C (especially on glass), PARYLENE™ N, and PARYLENE™ HT (for high temperature, ~300° C.) (available from Parylene Coating Services, Inc., Katy, Tex.); TEFLON® AF coatings; cytop; soldermasks, such as liquid photoimageable soldermasks (e.g., on PCB) like TAIYO™ PSR4000 series, TAIYO™ PSR and AUS series (available from Taiyo America, Inc. Carson City, Nev.) (good thermal characteristics for applications involving thermal control), and PROBIMER™ 8165 (good thermal characteristics for applications involving thermal control (available from Huntsman Advanced Materials Americas Inc., Los Angeles, Calif.); dry film soldermask, such as those in the VACREL® dry film soldermask line (available from DuPont, Wilmington, Del.); film dielectrics, such as polyimide film (e.g., KAPTON® polyimide film, available from DuPont, Wilmington, Del.), polyethylene, and fluoropolymers (e.g., FEP), polytetrafluoroethylene; polyester; polyethylene naphthalate; cyclo-olefin copolymer (COC); cyclo-olefin polymer (COP); any other PCB substrate material listed above; black matrix resin; polypropylene; and black flexible circuit materials, such as DuPont™ Pyralux® HXC and DuPont™ Kapton® MBC (available from DuPont, Wilmington, Del.). Droplet transport voltage and frequency may be selected for performance with reagents used in specific assay protocols. Design parameters may be varied, e.g., number and placement of on-actuator reservoirs, number of independent electrode connections, size (volume) of different reservoirs, placement of magnets/bead washing zones, electrode size, inter-electrode pitch, and gap height (between top and bottom substrates) may be varied for use with specific reagents, protocols, droplet volumes, etc.

In some cases, a substrate of the present disclosure may be derivatized with low surface-energy materials or chemistries, e.g., using deposition or in situ synthesis using poly- or per-fluorinated compounds in solution or polymerizable monomers. Examples include TEFLON® AF coatings and FLUOROPEL® coatings for dip or spray coating, other fluorinated monomers for plasma-enhanced chemical vapor deposition (PECVD), and organosiloxane (e.g., SiOC) for PECVD. Additionally, in some cases, some portion or all of the droplet operations surface may be coated with a substance for reducing background noise, such as background fluorescence from a PCB substrate. For example, the noise-reducing coating may include a black matrix resin, such as the black matrix resins available from Toray industries, Inc., Japan. Electrodes of a droplet actuator are typically controlled by a controller or a processor, which is itself provided as part of a system, which may include processing functions as well as data and software storage and input and output capabilities. Reagents may be provided on the droplet actuator in the droplet operations gap or in a reservoir fluidly coupled to the droplet operations gap. The reagents may be in liquid form, e.g., droplets, or they may be provided in a reconstitutable form in the droplet operations gap or in a reservoir fluidly coupled to the droplet operations gap. Reconstitutable reagents may typically be combined with liquids for reconstitution. An example of reconstitutable reagents suitable for use with the methods and apparatus set forth herein includes those described in Meathrel et al., U.S. Pat. No. 7,727,466, entitled "Disintegratable Films for Diagnostic Devices," issued on Jun. 1, 2010, the entire disclosure of which is incorporated herein by reference.

"Droplet operation" means any manipulation of a droplet on a droplet actuator. A droplet operation may, for example, include: loading a droplet into the droplet actuator; dispensing one or more droplets from a source droplet; splitting, separating or dividing a droplet into two or more droplets; transporting a droplet from one location to another in any direction; merging or combining two or more droplets into a single droplet; diluting a droplet; mixing a droplet; agitating a droplet; deforming a droplet; retaining a droplet in position; incubating a droplet; heating a droplet; vaporizing a droplet; cooling a droplet; disposing of a droplet; transporting a droplet out of a droplet actuator; other droplet operations described herein; and/or any combination of the foregoing. The terms "merge," "merging," "combine," "combining" and the like are used to describe the creation of one droplet from two or more droplets. It should be understood that when such a term is used in reference to two or more droplets, any combination of droplet operations that are sufficient to result in the combination of the two or more droplets into one droplet may be used. For example, "merging droplet A with droplet B," can be achieved by transporting droplet A into contact with a stationary droplet B, transporting droplet B into contact with a stationary droplet A, or transporting droplets A and B into contact with each other. The terms "splitting," "separating" and "dividing" are not intended to imply any particular outcome with respect to volume of the resulting droplets (i.e., the volume of the resulting droplets can be the same or different) or number of resulting droplets (the number of resulting droplets may be 2, 3, 4, 5 or more). The term "mixing" refers to droplet operations which result in more homogenous distribution of one or more components within a droplet. Examples of "loading" droplet operations include microdialysis loading, pressure assisted loading, robotic loading, passive loading, and pipette loading. Droplet operations may be electrode-mediated. In some cases, droplet operations are further facilitated by the use of hydrophilic and/or hydrophobic regions on surfaces and/or by physical obstacles. For examples of droplet operations, see the patents and patent applications cited above under the definition of "droplet actuator." Impedance or capacitance sensing or imaging techniques may sometimes be used to determine or confirm the outcome of a droplet operation. Examples of such techniques are described in Sturmer et al., U.S. Patent Pub. No. 20100194408, entitled "Capacitance Detection in a Droplet Actuator," published on Aug. 5, 2010, the entire disclosure of which is incorporated herein by reference. Generally speaking, the sensing or imaging techniques may be used to confirm the presence or absence of a droplet at a specific electrode. For example, the presence of a dispensed droplet at the destination electrode following a droplet dispensing operation confirms that the droplet dispensing operation was effective. Similarly, the presence of a droplet at a detection spot at an appropriate step in an assay protocol may confirm that a previous set of droplet operations has successfully produced a droplet for detection. Droplet transport time can be quite fast. For example, in various embodiments, transport of a droplet from one electrode to the next may exceed about 1 sec, or about 0.1 sec, or about 0.01 sec, or about 0.001 sec.

In one embodiment, the electrode is operated in AC mode but is switched to DC mode for imaging. It is helpful for conducting droplet operations for the footprint area of droplet to be similar to electrowetting area; in other words, 1×-, 2×-3×-droplets are usefully controlled operated using 1, 2, and 3 electrodes, respectively. If the droplet footprint is greater than number of electrodes available for conducting a droplet operation at a given time, the difference between the droplet size and the number of electrodes should typically not be greater than 1; in other words, a 2× droplet is usefully controlled using 1 electrode and a 3× droplet is usefully controlled using 2 electrodes. When droplets include beads, it is useful for droplet size to be equal to the number of electrodes controlling the droplet, e.g., transporting the droplet.

The terms "top," "bottom," "over," "under," and "on" are used throughout the description with reference to the relative positions of components of the droplet actuator, such as relative positions of top and bottom substrates of the droplet actuator. It will be appreciated that the droplet actuator is functional regardless of its orientation in space.

When a liquid in any form (e.g., a droplet or a continuous body, whether moving or stationary) is described as being "on", "at", or "over" an electrode, array, matrix or surface, such liquid could be either in direct contact with the electrode/array/matrix/surface, or could be in contact with one or more layers or films that are interposed between the liquid and the electrode/array/matrix/surface. In one example, filler fluid can be considered as a film between such liquid and the electrode/array/matrix/surface.

When a droplet is described as being "on" or "loaded on" a droplet actuator, it should be understood that the droplet is arranged on the droplet actuator in a manner which facilitates using the droplet actuator to conduct one or more droplet operations on the droplet, the droplet is arranged on the droplet actuator in a manner which facilitates sensing of a property of or a signal from the droplet, and/or the droplet has been subjected to a droplet operation on the droplet actuator.

The terms "fluidics cartridge," "digital fluidics cartridge," "droplet actuator," and "droplet actuator cartridge" as used throughout the description can be synonymous.

The term "opposite" is used herein throughout to describe the relation between modulation patterns, such as first and second modulation patterns. In certain embodiments, the first and second modulation patterns may be "exactly" opposite from one another. Alternatively, the modulation patterns may be generally opposite one another, but not necessarily exact opposites, such as when a DC average voltage is approximately zero after each cycle.

SUMMARY OF THE INVENTION

In accordance with embodiments, droplet actuator device for conducting droplet operations is provided that comprises a top substrate and a bottom substrate separated to form a gap that defines a device channel to conduct droplet operations. Electrodes are arranged proximate to at least one of the top and bottom substrates. A drive circuit is connected to the electrodes. The drive circuit generates an electrode drive signal to drive the droplet operations based on a reference waveform. The electrode drive signal is partitioned into an AC modulated drive cycle formed of sub-cycles. The electrode drive signal switches, during the sub-cycle, between at least first and second states where a degree of modulation with respect to the reference waveform forms a balanced modulation pattern.

The drive circuit partitions the AC modulated drive cycle into first and second half cycles, corresponding to the sub-cycles, the first half cycle having a first modulation pattern that is an opposite of a second modulation pattern of the second half cycle. The drive circuit utilizes at least one of phase modulation or pulse modulation during the AC modulated drive cycle to maintain a substantially zero DC bias. The drive circuit utilizes tri-state modulation to partition the AC modulated drive cycle, the tri-state modulation switching between the first and second states and a floating state. The drive cycle partitions the AC modulated drive cycle into two half cycles including a first half cycle and a second half cycle.

Optionally, the device may have memory storing programmable instructions and a processor executing the programmable instructions to generate a control input delivered to the drive circuit, the drive circuit generating the electrode drive signal based on a control input. The processor utilizes the control input to direct the drive circuit to modulate the electrode drive signal with respect to the reference waveform based on a modulation pattern stored in the memory. The processor divides the sub-cycles into timeslots and directs the drive circuit to switch the electrode drive signal to have one of the first and second states that differs from the reference waveform during at least a portion of the timeslot. The processor directs the drive circuit to increase a frequency of the electrode drive signal, with respect to the reference waveform, through pulse modulation. Optionally, the top and bottom substrates, electrodes and drive circuit are housed within a common housing forming a fluidics cartridge.

In accordance with embodiments, a method is provided for conducting droplet operations with a droplet actuator device having a top substrate and a bottom substrate separated to form a gap that defines a device channel to conduct droplet operations. Electrodes are arranged on at least one of the top and bottom substrates, and a drive circuit is connected to the electrodes. The method comprises generating an electrode drive signal based on a reference waveform, partitioning the electrode drive signal into an AC modulated drive cycle formed of sub-cycles and modulating the electrode drive signal with respect to the reference waveform, in connection with the sub-cycles, by switching between at least first and second states, where a degree of modulation with respect to the reference waveform forms a balanced modulation pattern.

Optionally, the partitioning includes partitioning a full AC cycle into a first half cycle and a second half cycle and partitioning each of the first and second half cycles into a common number of sub-cycles, the sub-cycles having equal timeslots. The method further comprises generating first and second modulation patterns for first and second sub-cycles, respectively, the first modulation pattern being an opposite of the second modulation pattern. The method further comprises driving a corresponding electrode using the first and second modulation patterns combined to form a full modulation pattern.

Optionally, the modulating operation includes phase shifting the electrode drive signal, with respect to the reference waveform, to achieve at least 25% modulation with respect to the reference waveform. The modulation operation switches between the at least first and second voltages based on a multi-bit modulation pattern defining the balanced modulation pattern. The modulating operation includes switching the electrode drive signal, during each of the sub-cycles, between a high state, a low state and a floating state, the high and low states corresponding to the first and second states.

DESCRIPTION

Embodiments herein provide systems and methods of balanced AC modulation for driving droplet operations electrodes, wherein the methods and systems use various balanced AC modulation technique, such as balanced phase modulation and/or balanced pulse modulation. Further, a balanced AC modulation scheme is described in which the voltage of any output (and voltage between any two outputs) is managed to average out to zero over the course of each cycle. Additionally, the balanced AC modulation scheme can provide independent voltage control of multiple electrodes while maintaining low or zero DC bias. For example, it is beneficial to have independent control over the electrode voltages in a fluidics cartridge (e.g., droplet actuator) that is not necessarily homogeneous (e.g., varying channel dimensions, varying temperature, varying droplet volume, etc.).

The balanced AC modulation scheme with low or zero DC bias can be used to achieve intermediate voltages (i.e., voltages somewhere between the full on and full off states) in a microfluidics system. The balanced AC modulation scheme uses phase modulation and/or pulse modulation and simple binary or tri-state (high, low, and off) driving circuits. The modulation pattern achieves an intermediate voltage because it is time-averaged across each AC cycle.

In the balanced AC modulation schemes described herein, in order to maintain low or zero DC bias using phase modulation and/or pulse modulation, the modulation pattern in the first half of the AC cycle is set to be the opposite of the pattern in the second half of the AC cycle. Inverting the same pattern provides the desired balance to ensure that the two half cycles offset each other. For binary modulation this means any high value on the first half cycle at some position is low on the second half cycle at that same position and vice versa. Tri-state (or 3-state or three-state) modulation also obeys this rule with the added requirement that any floating state in one half cycle at a certain position is also floating in the other half cycle in that same position.

Figure 1:
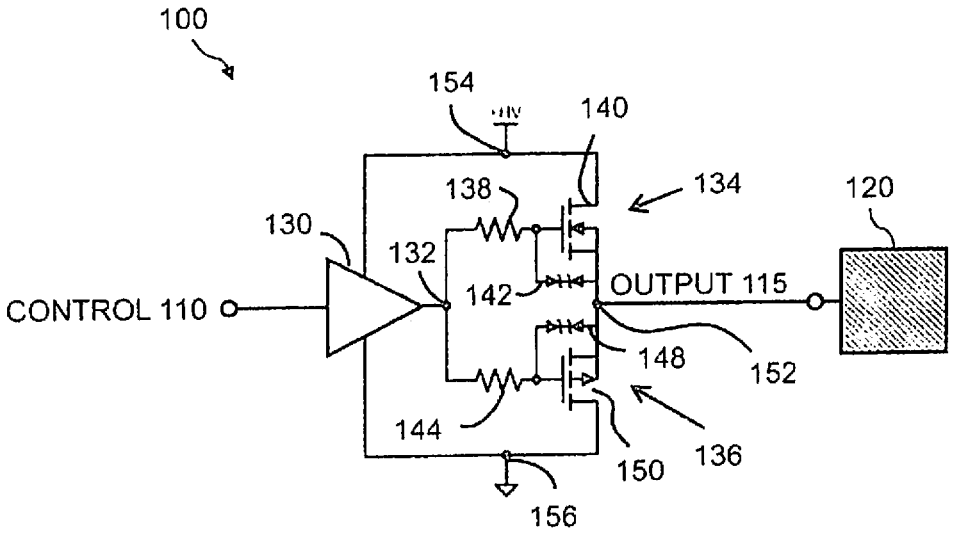
FIG. 1 illustrates a schematic diagram of an example of a drive circuit for driving droplet operations electrodes with balanced AC modulation in accordance with embodiments herein.
Figure 12:
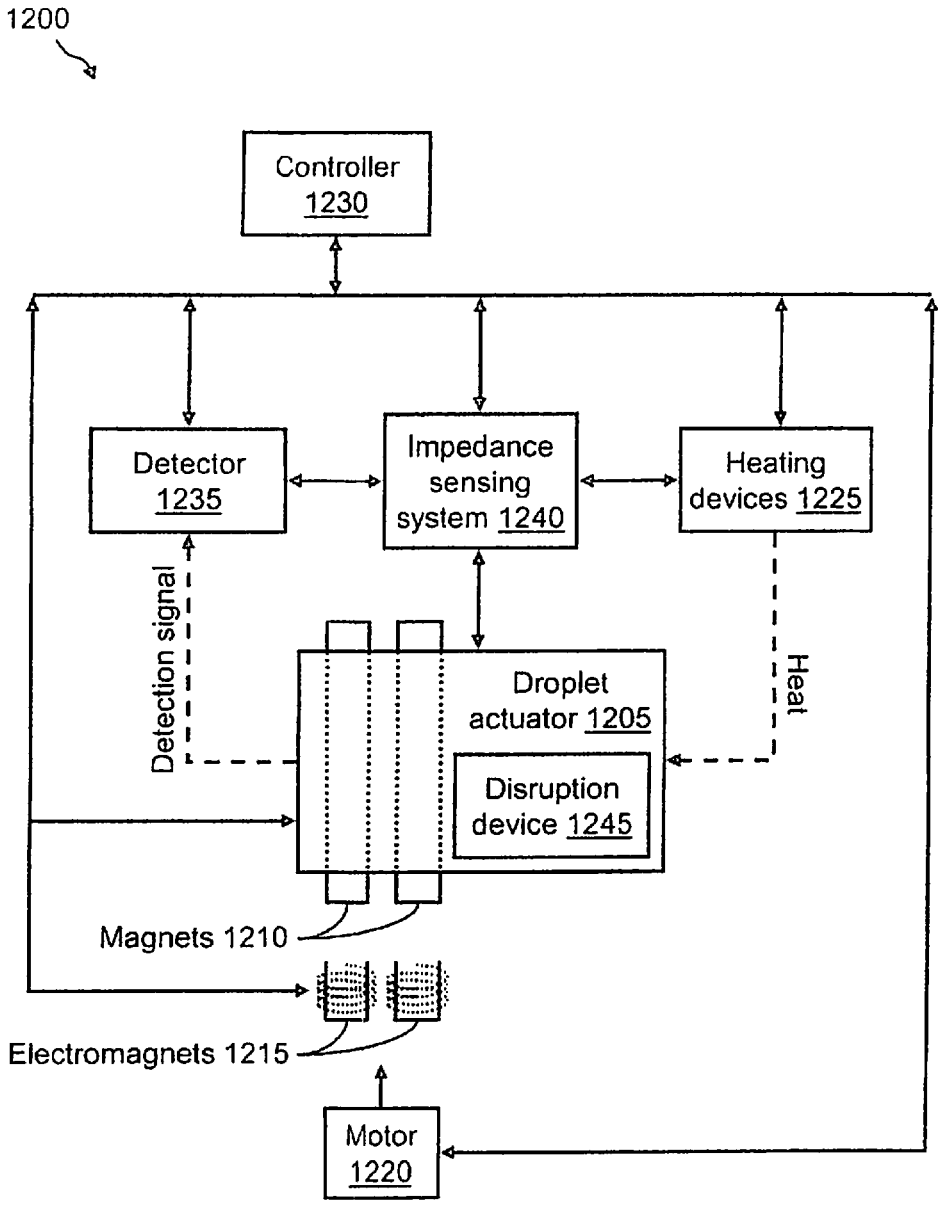
FIG. 12 illustrates a functional block diagram of an example of a microfluidics system that includes a droplet actuator in accordance with embodiments herein.
Figure 13:
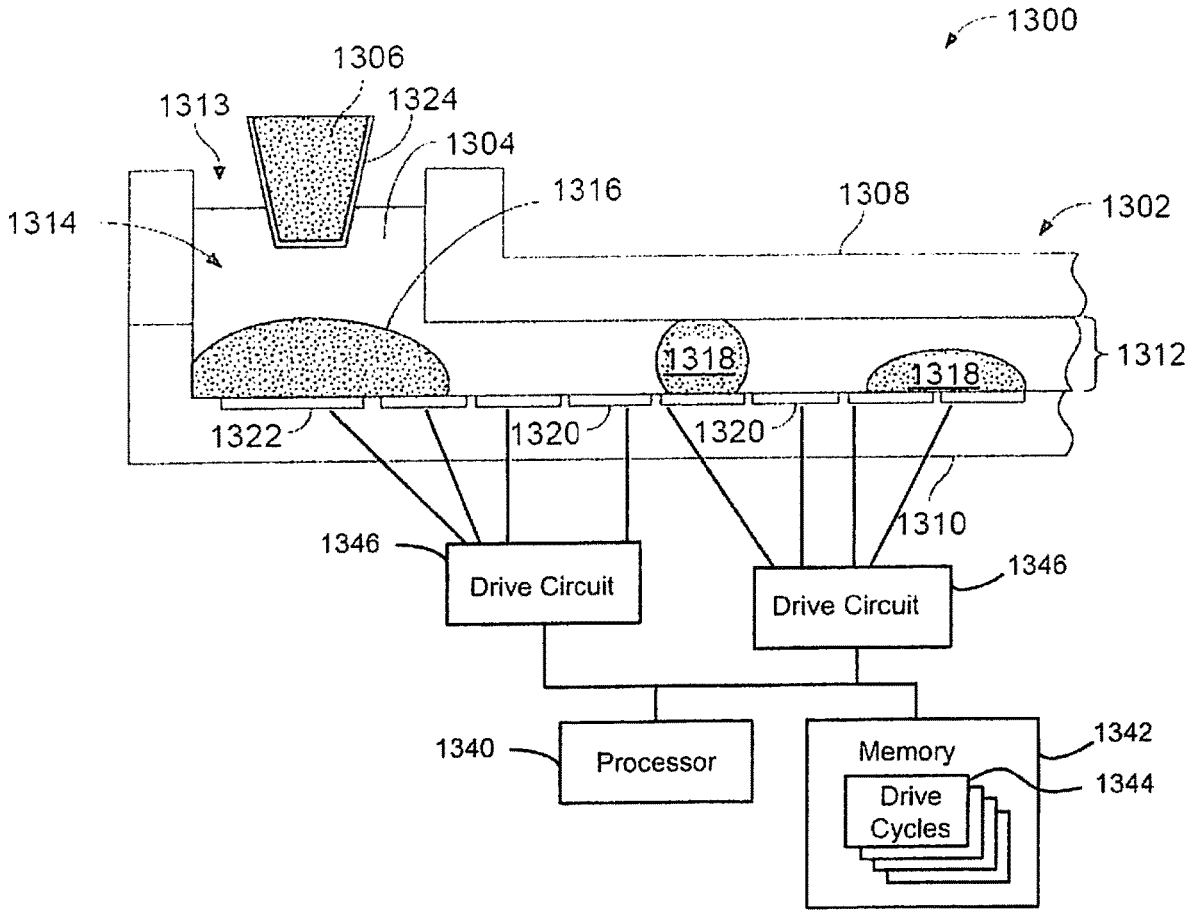
FIG. 13 illustrates a cross-section of a portion of a droplet actuator device that utilizes drive circuits in accordance with embodiments herein.

FIG. 1 illustrates a schematic diagram of an example of a drive circuit 100 for driving droplet operations electrodes with balanced AC modulation in accordance with embodiments herein. Drive circuit 100 includes a high-voltage buffer that has a control input 110 and an output 115. The output 115 can connect to one or more droplet operations electrodes 120 in a fluidics cartridge, such as a droplet actuator (FIGS. 12 and 13). The output 115 of drive circuit 100 switches between an electrowetting voltage (+HV) and ground (or about zero volts). The electrowetting voltage (+HV) is a high DC voltage that can range, for example, from about 100 VDC to about 2500 VDC. In one example, when control input 110 is a 0 logic level, then output 115 is set to ground (or about zero volts), and when control input 110 is a 1 logic level, then output 115 is set to about the electrowetting voltage (+HV).

The drive circuit 100 includes an operational amplifier 130, an input to which represents the control input 110. An output of the operational amplifier 130 branches at node 132 along parallel branches 134 and 136. The branch 134 includes a resistor 138 connected in series with a Zener diode clipping circuit 142 coupled between the gate and source terminals of an n-channel MOSFET 140. The branch 136 includes a resistor 144 connected in series with a Zener diode clipping circuit 148 coupled between the gate and source terminals of a p-channel MOSFET 150. The source terminal of the MOSFET 150 is coupled at node 152 to the source terminal of MOSFET 140 to jointly form the output 115. A high-voltage supply 154 and ground 156 are coupled to the amplifier 130. The high-voltage supply 154 is coupled to the drain terminal of the MOSFET 140, while the ground 156 is coupled to the drain terminal of the MOSFET 150.

The control input 110 receives various bit modulation patterns as described herein in connection with FIGS. 3-7. The control input 110 alternate between first and second states (e.g. a high and a low state) such as corresponding to the logical values of 1 and 0. The MOSFETs 140 and 150 alternate between open and closed states based upon the signals provided through node 132 to the bases thereof, thereby generating the electrode drive signals (at output 115) as discussed herein in connection with FIGS. 3-7.

Figure 2:
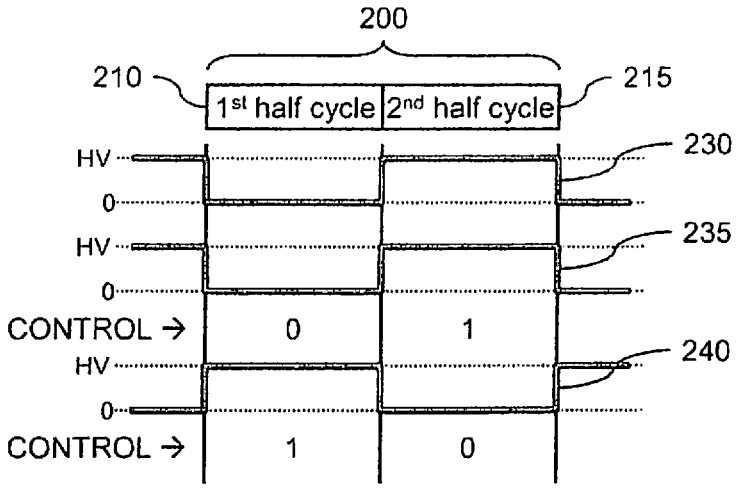
FIG. 2 illustrates an example of an AC drive cycle for driving droplet operations electrodes, wherein the AC drive cycle is not modulated.

FIG. 2 illustrates an example of an AC drive cycle 200 for driving droplet operations electrodes, wherein the standard AC drive cycle 200 is not modulated. The AC drive cycle 200 is formed of two half cycles. For example, AC drive cycle 200 includes a first half cycle 210 and a second half cycle 215. FIG. 2 shows a reference waveform 230 switching between zero volts and the electrowetting voltage (+HV). Reference waveform 230 represents the voltage profile of the reference to which the other electrode voltages are being compared/measured. In a microfluidics system (i.e., an electrowetting system), the reference waveform 230 is typically applied to one or more electrodes, referred to as a reference electrode. The reference electrode is located near or in contact with the droplet being manipulated. For example, the reference electrode may define a reference plane or ground plane.

FIG. 2 shows an electrode drive signal 235 that is supplied to one or more electrodes, referred to as a drive electrode. The drive and reference electrodes may be located on opposite sides of a device channel (e.g., 1312 in FIG. 13). Optionally, the reference and drive electrodes may be located adjacent one another on a common side of the device channel. One of the reference and drive electrodes are electrically coupled to the droplet while the other of the reference and drive electrodes are electrically separated from the droplet. For example, the reference electrode may contact the droplet such that the droplet maintains the voltage profile of the reference waveform. When the droplet maintains the voltage profile of the reference waveform, a potential difference occurs (at select times) between the droplet and the drive electrode, thereby facilitating the electro-wetting operations.

In one example of FIG. 2, when the electrode drive signal 235 is in phase with reference waveform 230, there is zero volts present across the droplet. In the alternative example of FIG. 2, when an alternative electrode drive signal 240 is utilized, which is completely out of phase with reference waveform 230, there is always a high voltage (e.g., 2×+HV) present across the droplet. In this case, the root mean square (RMS) voltage at the droplet is substantially equal to the electrowetting voltage (+HV). Electrode drive signal 235 and electrode drive signal 240 are examples of unmodulated drive signals for driving the droplet operations electrodes.

FIG. 3 through FIG. 7 illustrate examples of AC modulated drive cycles 300 implemented by the drive circuit 100 of FIG. 1, wherein the AC modulated drive cycles 300 uses phase modulation and/or pulse modulation to provide balanced AC modulation in accordance with embodiments herein.

In the examples of FIGS. 3-7, the reference waveform 230 is applied to a reference electrode located near or in contact with the droplet being manipulated. The reference electrode may define a reference plane or ground plane. In the examples of FIGS. 3-7, various electrode drive signals are supplied to one or more drive electrodes. The drive and reference electrodes may be located on opposite sides of a device channel (e.g., 1312 in FIG. 13). Optionally, the reference and drive electrodes may be located adjacent one another on a common side of the device channel. One of the reference and drive electrodes are electrically coupled to the droplet, while the other of the reference and drive electrodes are electrically separated from the droplet. For example, the reference electrode may contact the droplet such that the droplet maintains the voltage profile of the reference waveform.

Figure 3:
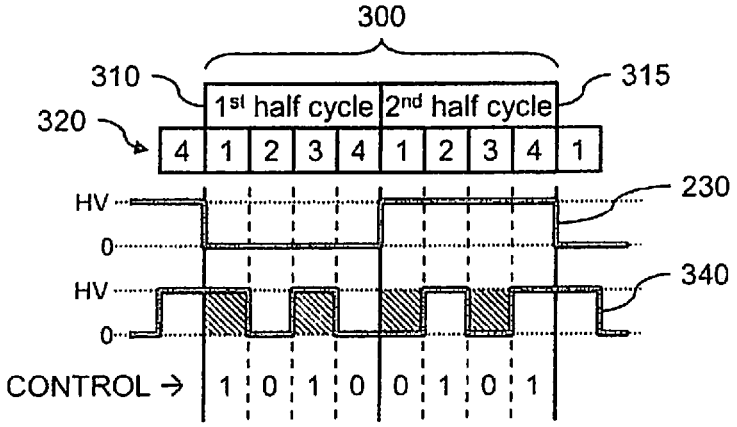
FIG. 3 illustrates examples of AC modulated drive cycles of the drive circuit of FIG. 1, wherein the AC modulated drive cycles provide balanced AC modulation in accordance with embodiments herein.

FIG. 3 illustrates an AC modulated drive cycle 300 that is formed of two half cycles. For example, AC modulated drive cycle 300 includes a first half cycle 310 and a second half cycle 315. Additionally, each of first half cycle 310 and second half cycle 315 is partitioned into multiple sub-cycles 320 and the same number of sub-cycles 320, wherein the multiple sub-cycles 320 are equal time slices. In one example, first half-cycle 310 is partitioned into four sub-cycles 320, and the second half-cycle 315 is partitioned into four sub-cycles 320, making a total of eight sub-cycles 320 in the full AC modulated drive cycle 300.

FIG. 3 shows an electrode drive signal 340 that is generated by the drive circuit 100 (FIG. 1) in accordance with embodiments herein and that is 50% modulated with respect to reference waveform 230. Electrode drive signal 340 is an example of using pulse modulation to provide balanced AC modulation for driving one or more droplet operations electrodes, such as droplet operations electrode 120 in FIG. 1. The electrode drive signal 340 is partitioned into the AC modulated drive cycle 300 formed of sub-cycles 320. The electrode drive signal 340 switches between high and low states in connection with the sub-cycles 320.0

Using pulse modulation, the drive circuit 100 generates multiple pulses in the first half-cycle and multiple opposite pulses in the second half-cycle. For example, the electrode drive signal 340 may have two or more transitions in the first half-cycle, with two or more corresponding opposite transitions occurring in the second half-cycle. In this way, the second half-cycle averages out to the opposite voltage of the average for the first half-cycle. Pulse modulation uses short pulses in the first half-cycle to achieve the desired average voltage. Because the pulses are short, the frequency is higher than reference waveform 230, which makes it easier to filter out the switching to achieve a smoother average voltage at the electrode. The voltage at the electrode may be smoothed out by increasing the pulse frequency, which increases the power drawn from the high voltage supply (e.g., electrowetting voltage (+HV), and/or by increasing the "strength" of the low-pass filter (not shown) being used for smoothing.

In the embodiment of FIG. 3, the electrode drive signal 340 is 50% modulated with respect to reference waveform 230. Throughout, the term modulation as used in connection with percentages shall refer to the percentage of time in which an electrode drive signal has a voltage different than a reference waveform. For example, 50% modulation means that 50% of the time, electrode drive signal 340 has a voltage different than that of reference waveform 230. The shaded portion of electrode drive signal 340 indicates when the voltage of electrode drive signal 340 is different than reference waveform 230. Namely, time slices 1 and 3 of first half-cycle 910 and time slices 1 and 3 of second half-cycle 915 are different than reference waveform 230. In this example, the 8-bit modulation pattern of control input 110 for producing the balanced AC modulation is "1010_0101." Again, note that the 4-bit modulation pattern for second half-cycle 315 is the opposite of the 4-bit modulation pattern for first half-cycle 310. In electrode drive signal 340 of FIG. 3, the effective RMS voltage at the droplet is about 50% of the electrowetting voltage (+HV).

Figure 4:
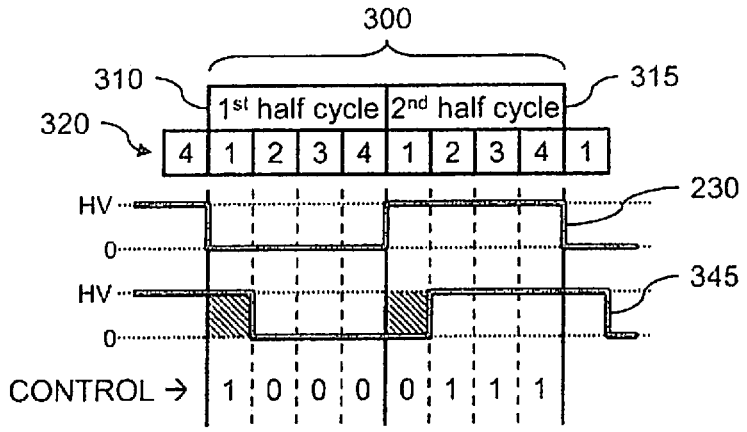
FIG. 4 illustrates examples of AC modulated drive cycles of the drive circuit of FIG. 1, wherein the AC modulated drive cycles provide balanced AC modulation in accordance with embodiments herein.

FIG. 4 illustrates an AC modulated drive cycle 300 that is associated with an electrode drive signal 345 that is generated by the drive circuit 100 (FIG. 1) in accordance with an embodiment herein. Electrode drive signal 345 is an example of using phase modulation to provide balanced AC modulation for driving one or more droplet operations electrodes, such as droplet operations electrode 120 in FIG. 1. Using phase modulation, a square wave, for example, is shifted more and more out of phase with square wave reference waveform 230, to achieve higher and higher average voltage differential. Phase modulation uses a lower switching frequency and therefore draws less power from the high voltage supply (e.g., electrowetting voltage (+HV) as compared to the embodiment of FIG. 3.

In the embodiment of FIG. 4, electrode drive signal 345 is phase-shifted by +45 degrees with respect to reference waveform 230 to achieve 25% modulation. The 25% modulation means that 25% of the time, electrode drive signal 345 has a voltage different than that of reference waveform 230. The shaded portion of electrode drive signal 345 indicates when the voltage of electrode drive signal 345 is different than reference waveform 230. Namely, during time slice 1 of first half-cycle 310 and time slice 1 of second half-cycle 315 the voltage of the electrode drive signal 345 is different than reference waveform 230. In electrode drive signal 345 of FIG. 4, the effective RMS voltage at the droplet is about 25% of the electrowetting voltage (+HV).

FIG. 4 shows the programmed logic pattern of the control input 110 (FIG. 1) that produces the 25% balanced AC modulation. In this example, the 8-bit modulation pattern of control input 110 is "1000_0111." Note that the 4-bit modulation pattern for second half-cycle 315 is the opposite of the 4-bit modulation pattern for first half-cycle 310.

Figure 5:
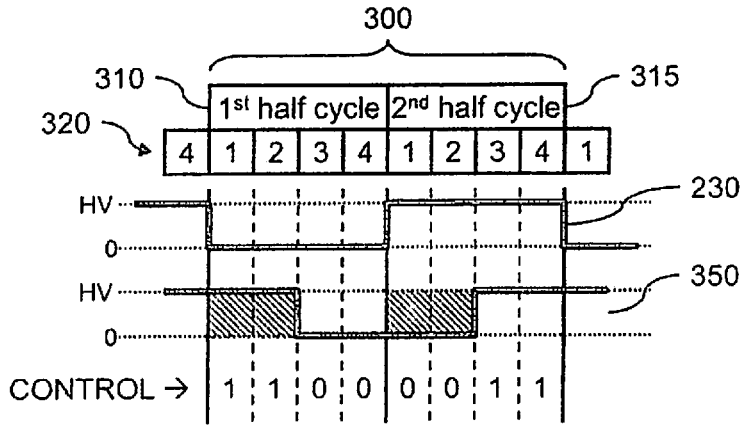
FIG. 5 illustrates examples of AC modulated drive cycles of the drive circuit of FIG. 1, wherein the AC modulated drive cycles provide balanced AC modulation in accordance with embodiments herein.

FIG. 5 illustrates an AC modulated drive cycle 300 that is associated with an electrode drive signal 350 that is generated by the drive circuit 100 (FIG. 1) in accordance with an embodiment herein. Electrode drive signal 350 is another example of using phase modulation to provide balanced AC modulation for driving one or more droplet operations electrodes, such as droplet operations electrode 120 in FIG. 1. In this example, electrode drive signal 350 is phase-shifted by +90 degrees with respect to the reference waveform 230 to achieve 50% modulation with respect to reference waveform 230. The 50% modulation means that 50% of the time, electrode drive signal 350 has a voltage different than that of reference waveform 230. The shaded portion of an electrode drive signal 350 indicates when the voltage of electrode drive signal 350 is different than reference waveform 230. Namely, during time slices 1 and 2 of first half-cycle 910 and time slices 1 and 2 of second half-cycle 915 the voltage of the electrode drive signal 350 is different than reference waveform 230. In this example, the 8-bit modulation pattern of control input 110 for producing the balanced AC modulation is "1100_0011." Again, note that the 4-bit modulation pattern for second half-cycle 315 is the opposite of the 4-bit modulation pattern for first half-cycle 310. In electrode drive signal 350 of FIG. 5, the effective RMS voltage at the droplet is about 50% of the electrowetting voltage (+HV).

Figure 6:
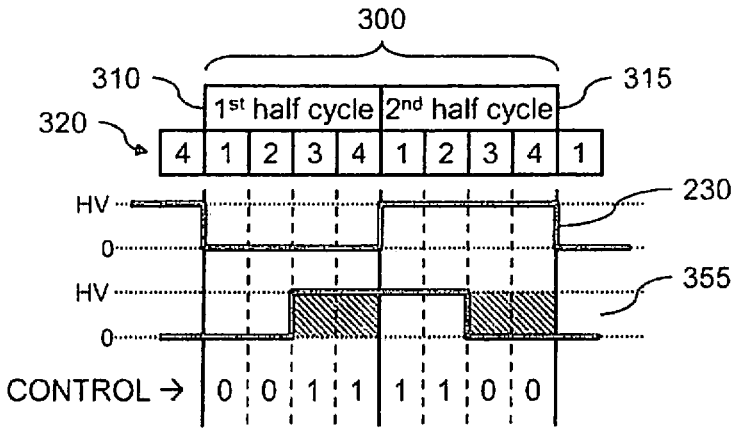
FIG. 6 illustrates examples of AC modulated drive cycles of the drive circuit of FIG. 1, wherein the AC modulated drive cycles provide balanced AC modulation in accordance with embodiments herein.

FIG. 6 illustrates an AC modulated drive cycle 300 is association with an electrode drive signal 355 that is generated by the drive circuit 100 (FIG. 1) in accordance with an embodiment. Electrode drive signal 355 is another example of using phase modulation to provide balanced AC modulation for driving one or more droplet operations electrodes, such as droplet operations electrode 120 in FIG. 1. In this example, electrode drive signal 355 is phase-shifted by −90 degrees to achieve 50% modulation with respect to reference waveform 230. The shaded portion of an electrode drive signal 355 indicates when the voltage of electrode drive signal 355 is different than reference waveform 230. Namely, during the time slices 3 and 4 of first half-cycle 910 and time slices 3 and 4 of second half-cycle 915, the electrode drive signal 355 is different than reference waveform 230. In this example, the 8-bit modulation pattern of control input 110 for producing the balanced AC modulation is "0011_1100." Again, note that the 4-bit modulation pattern for second half-cycle 315 is the opposite of the 4-bit modulation pattern for first half-cycle 310. In electrode drive signal 355 of FIG. 6, the effective RMS voltage at the droplet is about 50% of the electrowetting voltage (+HV).

Figure 7:
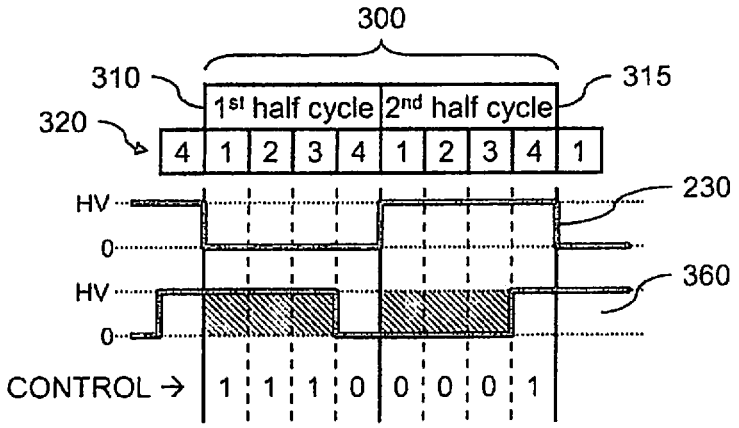
FIG. 7 illustrates examples of AC modulated drive cycles of the drive circuit of FIG. 1, wherein the AC modulated drive cycles provide balanced AC modulation in accordance with embodiments herein.

FIG. 7 illustrates an AC modulated drive cycle 300 that is association with an electrode drive signal 360 that is generated by the drive circuit 100 (FIG. 1) in accordance with an embodiment. Electrode drive signal 360 is yet another example of using phase modulation to provide balanced AC modulation for driving one or more droplet operations electrodes, such as droplet operations electrode 120 in FIG. 1. In this example, electrode drive signal 360 is phase-shifted by +135 degrees to achieve 75% modulation with respect to reference waveform 230. The 75% modulation means that 75% of the time, electrode drive signal 350 has a voltage different than that of reference waveform 230. The shaded portion of electrode drive signal 360 indicates when the voltage of electrode drive signal 360 is different than reference waveform 230. Namely, during the time slices 1, 2, and 3 of first half-cycle 910 and time slices 1, 2, and 3 of second half-cycle 915, the electrode signal 360 is different than reference waveform 230. In this example, the 8-bit modulation pattern of control input 110 for producing the balanced AC modulation is "1110_0001." Again, note that the 4-bit modulation pattern for second half-cycle 315 is the opposite of the 4-bit modulation pattern for first half-cycle 310. In electrode drive signal 360 of FIG. 7, the effective RMS voltage at the droplet is about 75% of the electrowetting voltage (+HV).

Figure 8:
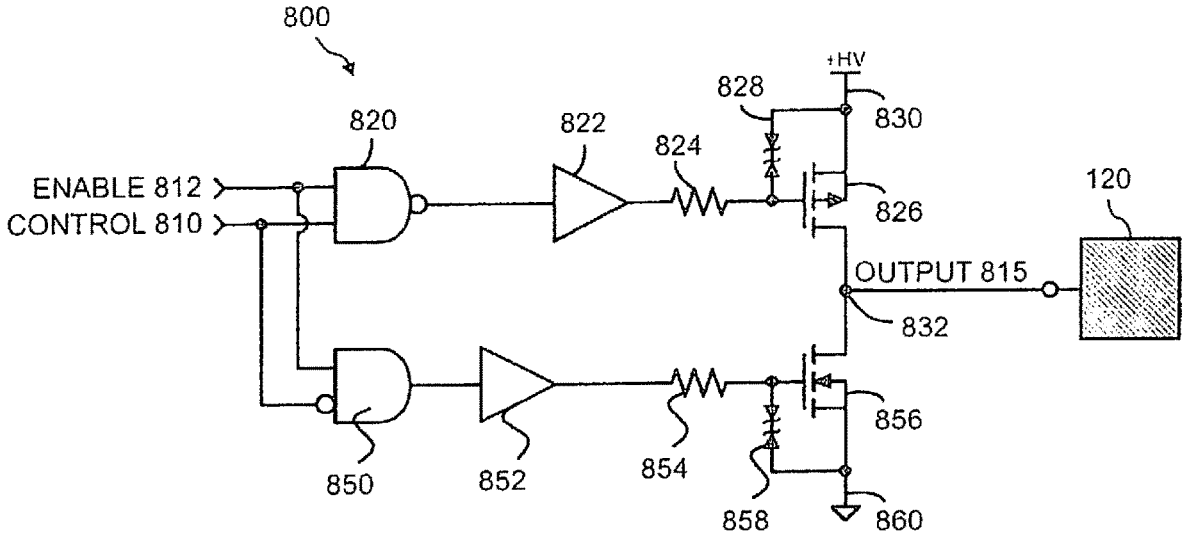
FIG. 8 illustrates a schematic diagram of another example of a drive circuit for driving droplet operations electrodes with balanced AC modulation, wherein the drive circuit supports a tri-state function in accordance with embodiments herein.

FIG. 8 illustrates a simplified schematic diagram of another example of a drive circuit 800 for driving droplet operations electrodes with balanced AC modulation, wherein drive circuit 800 supports a tri-state function. Namely, in addition to the high and low levels, the output can assume a high impedance state, or floating state, which is referred to as a tri-state, 3-state, or three-state condition. It is recognized that the diagram represents a simplified schematic as there are other features the drive circuit 800, such as to avoid both MOSFETs being turned on at the same time. For example, when the drive circuit 800 remains enabled and the CONTROL input changes state, the drive circuit 800 would ensure that the MOSFET, that was on, turns off before the MOSFET, that was off, turns on.

Drive circuit 800 has a control input 810, an enable input 812, and an output 815. Output 815 can connect to one or more droplet operations electrodes 820 in a fluidics cartridge, such as a droplet actuator (not shown). The output 815 of drive circuit 800 can switch between the electrowetting voltage (+HV) and ground (or about zero volts). Further, the output 815 of drive circuit 800 can be set to the tri-state condition (i.e., the high impedance state).

Enable input 812 controls whether output 815 of drive circuit 800 is in the tri-state condition or not. For example, when enable input 812 is a low 0 logic level, output 815 is in the tri-state condition. In the tri-state condition, the state of control input 810 is a "don't care."

Figure 9:
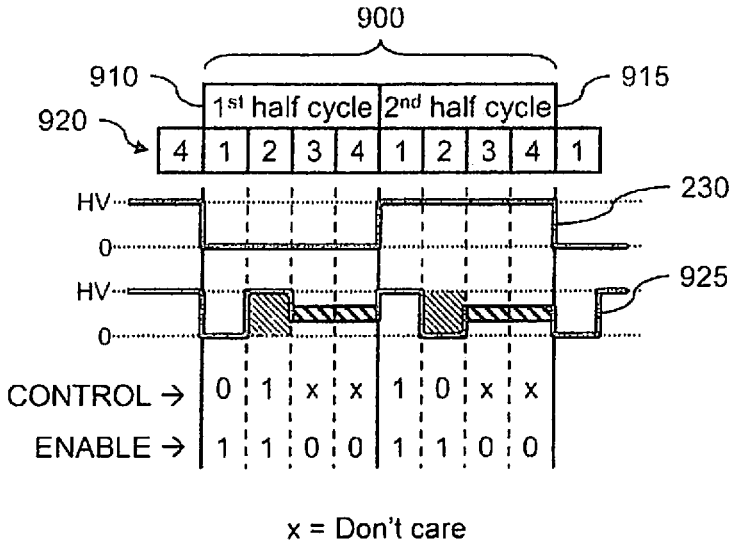
FIG. 9 illustrates examples of AC modulated drive cycles of the drive circuit of FIG. 8, wherein the AC modulated drive cycles provide balanced AC modulation in accordance with embodiments herein.
Figure 10:
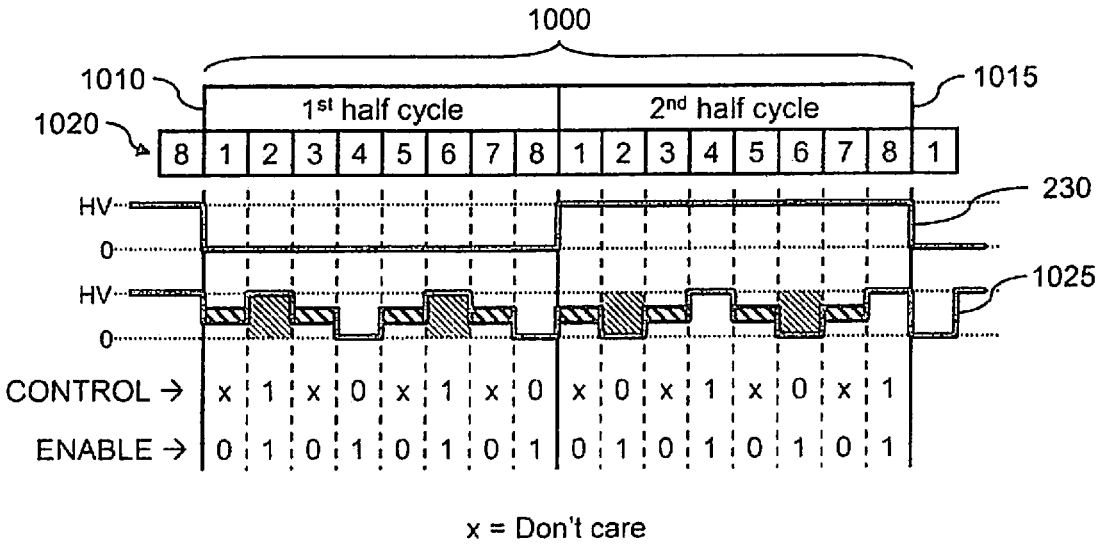
FIG. 10 illustrates examples of AC modulated drive cycles of the drive circuit of FIG. 8, wherein the AC modulated drive cycles provide balanced AC modulation in accordance with embodiments herein.

However, when enable input 812 is a high 1 logic level, output 815 follows control input 810. In one example, when enable input 812 is a 1 logic level and when control input 810 is a 0 logic level, then output 815 is set to ground (or about zero volts). Similarly, when enable input 812 is a 1 logic level and when control input 810 is a 1 logic level, then output 815 is set to about the electrowetting voltage (+HV). FIG. 9 and FIG. 10 illustrate examples of AC modulated drive cycles of drive circuit 800 of FIG. 8 that supports the tri-state function, wherein the AC modulated drive cycles provide balanced AC modulation according to the embodiments herein.

The drive circuit 800 includes a NAND gate 820 that receives the enable input 812 and control input 810. The output of the NAND gate 820 switches to a high state when one or both of the enable input 812 and control input 810 have a low state. Otherwise, the output of the NAND gate 820 remains in a low state. The NAND gate 820 is connected in series with an amplifier 822, a resistor 824, and a MOSFET 826. A Zener diode clipping circuit 828 is coupled between the gate and source terminals of the MOSFET 826. The diode clipping circuit 828 and the source of the MOSFET 826 are connected to a high-voltage source 830. A drain terminal of the MOSFET 826 is connected to the output 815 at node 832.

The drive circuit 800 also includes an AND gate 850 that receives the enable input 812 and control input 810 (after being inverted). The output of the AND gate 850 switches to a high state when the enable input 812 is in a high state and the control input 810 is in a low state. Otherwise, the output of the AND gate 850 remain in a low state. The AND gate 850 is connected in series with an amplifier 852, a resistor 854, and a MOSFET 856. A Zener diode clipping circuit 858 is coupled between the gate and source terminals of the MOSFET 856. The diode clipping circuit 858 and the source of the MOSFET 826 are connected to ground 860. A drain terminal of the MOSFET 856 is connected to the output 815 at node 832. In the present example, the MOSFET 826 represents a p-channel device, while the MOSFET 856 represents an n-channel device. It is recognized that alternative configurations may be utilized.

The control input 810 receives various bit modulation patterns as described herein in connection with FIGS. 9-10. The control input 810 (and the enable input 812) alternate between first and second states (e.g. a high and a low state) such as corresponding to the logical values of 1 and 0. The MOSFETs 826 and 856 alternate between open, closed and floating based upon the signals provided to the bases of the MOSFETs 826, 856, thereby generating the electrode drive signals (at output 815) as discussed herein in connection with FIGS. 9 and 10.

FIG. 9 illustrates an AC modulated drive cycle 900 is formed of two half cycles generated by the drive circuit 800 (FIG. 8) in accordance with embodiments herein. For example, AC modulated drive cycle 900 includes a first half cycle 910 and a second half cycle 915. Additionally, each of first half cycle 910 and second half cycle 915 is partitioned into multiple sub-cycles 920 and the same number of sub-cycles 920, wherein the multiple sub-cycles 920 are equal time slices. In one example, first half-cycle 910 is partitioned into four sub-cycles 920. Similarly, the second half-cycle 915 is partitioned into four sub-cycles 920, making a total of eight sub-cycles 920 in the full AC modulated drive cycle 900. FIG. 9 also shows AC modulated drive cycle 900 with respect to reference waveform 230.

FIG. 9 shows an electrode drive signal 925 generated by the drive circuit 800 (FIG. 8) in accordance with embodiments herein. Electrode drive signal 925 is an example of using pulse modulation to provide balanced AC modulation for driving one or more droplet operations electrodes, such as droplet operations electrode 120 in FIG. 1. Further, electrode drive signal 925 is an example of 25% modulation with respect to reference waveform 230. In this example, time slice 2 of first half-cycle 910 and time slice 2 of second half-cycle 915 is different than reference waveform 230. In addition to being 25% modulated, a portion of electrode drive signal 925 is in the tri-state condition. Namely, during the time slices 3 and 4 of first half-cycle 910 and time slices 3 and 4 of second half-cycle 915, the electrode drive signal 925 is set to tri-state.

FIG. 9 shows the programmed logic pattern of the control (e.g., control input 110 of drive circuit 100 of FIG. 1) that produces the balanced AC modulation. In this example, the 8-bit modulation pattern of enable input 812 is "1100_1100" and the 8-bit modulation pattern of control input 810 is "01xx_10xx." With respect to control input 810, the 4-bit modulation pattern for second half-cycle 915 is the opposite of the 4-bit modulation pattern for first half-cycle 910. Further, because enable input 812 is turned off for time slices 3 and 4 of first half-cycle 910 and time slices 3 and 4 of second half-cycle 915, the state of control input 810 is a "don't care" during time slices 3 and 4 of first half-cycle 910 and time slices 3 and 4 of second half-cycle 915. The "x" in the control input 810 represents a floating state wherein the drive electrode is disconnected from the drive circuit or any specific voltage and the potential of the drive electrode floats based on the ambient electric field. Permitting the drive electrode to "float" at select portions of the drive cycle may reduce creation of bubbles at the droplets.

FIG. 10 illustrates an AC modulated drive cycle 1000 that is formed of two half cycles. For example, AC modulated drive cycle 1000 includes a first half cycle 1010 and a second half cycle 1015. Additionally, each of first half cycle 1010 and second half cycle 1015 is partitioned into multiple sub-cycles 1020 and the same number of sub-cycles 1020, wherein the multiple sub-cycles 1020 are equal time slices. In one example, first half-cycle 1010 is partitioned into eight sub-cycles 1020, and the second half-cycle 1015 is partitioned into eight sub-cycles 1020, making a total of sixteen sub-cycles 1020 in the full AC modulated drive cycle 1000. FIG. 10 also shows AC modulated drive cycle 1000 with respect to reference waveform 230.

FIG. 10 shows an electrode drive signal 1025 generated by the drive circuit 800 (FIG. 8) in accordance with embodiments herein. Electrode drive signal 1025 is another example of using pulse modulation to provide balanced AC modulation for driving one or more droplet operations electrodes, such as droplet operations electrode 120 in FIG. 1. Further, electrode drive signal 1025 is an example of 25% modulation with respect to reference waveform 230. In this example, time slices 2 and 6 of first half-cycle 1010 and time slices 2 and 6 of second half-cycle 1015 are different than reference waveform 230. In addition to being 25% modulated, a portion of electrode drive signal 1025 is in the tri-state condition. Namely, during time slices 1, 3, 5, and 7 of first half-cycle 1010 and time slices 1, 3, 5, and 7 of second half-cycle 1015, the electrode drive signal 1025 is set to tri-state, i.e., every other time slice is set to tri-state.

FIG. 10 shows the programmed logic pattern of the control (e.g., control input 110 of drive circuit 100 of FIG. 1) that produces the balanced AC modulation. In this example, the 16-bit modulation pattern of enable input 812 is "01010101_01010101" and the 16-bit modulation pattern of control input 810 is "x0x1x0x1_x1x0x1x0." With respect to control input 810, the 8-bit modulation pattern for second half-cycle 1015 is the opposite of the 8-bit modulation pattern for first half-cycle 1010. Further, because enable input 812 is turned off for time slices 1, 3, 5, and 7 of first half-cycle 1010 and time slices 1, 3, 5, and 7 of second half-cycle 1015, the state of control input 810 is a "don't care" during time slices 1, 3, 5, and 7 of first half-cycle 1010 and time slices 1, 3, 5, and 7 of second half-cycle 1015.

In electrode drive signal 925 of FIG. 9 and electrode drive signal 1025 of FIG. 10, the tri-state sub-cycles in the second half cycle should mirror the tri-state sub-cycles in the first half cycle.

In electrode drive signal 925 of FIG. 9 and electrode drive signal 1025 of FIG. 10, even though the signals are 25% modulated, the presence of the tri-state sub-cycles causes the effective RMS voltage at the droplet to be some amount greater than 25% of the electrowetting voltage (+HV) depending on the parasitic capacitance of the system.

Further and referring now to FIGS. 2 through 10, the use of phase modulation, pulse modulation, and/or the presence of the tri-state sub-cycles provide ways to control the peak-to-peak voltage across the droplet and/or to control the edge rate (rise time and/or fall time) of the electrode drive signal. For example, increasing the frequency of the electrode drive signal using pulse modulation may be a way to reduce the peak-to-peak voltage across the droplet by not allowing enough time for the electrode drive signal to reach the maximum voltage. Essentially, "flattening out" the electrode drive signal in those sub-cycles.

Further and referring again to FIGS. 2 through 10, both sufficient voltage and sufficient percent modulation are maintained to drive the droplet in the fluidics cartridge. Further, zero DC bias is maintained throughout any AC modulated drive cycle.

Further and referring again to FIGS. 2 through 10, the number of sub-cycles in each half cycle is not limited to four or eight. There can be at least two, or any number greater than two, sub-cycles in each half cycle. The more sub-cycles that are present, the more granularity there is with respect to setting the RMS voltage across the droplet. For example, four sub-cycles per half cycle allows granularity of one quarter of the RMS voltage, eight sub-cycles per half cycle allows granularity of one eighth of the RMS voltage, sixteen sub-cycles per half cycle allows granularity of one sixteenth of the RMS voltage, and so on.

Figure 11:
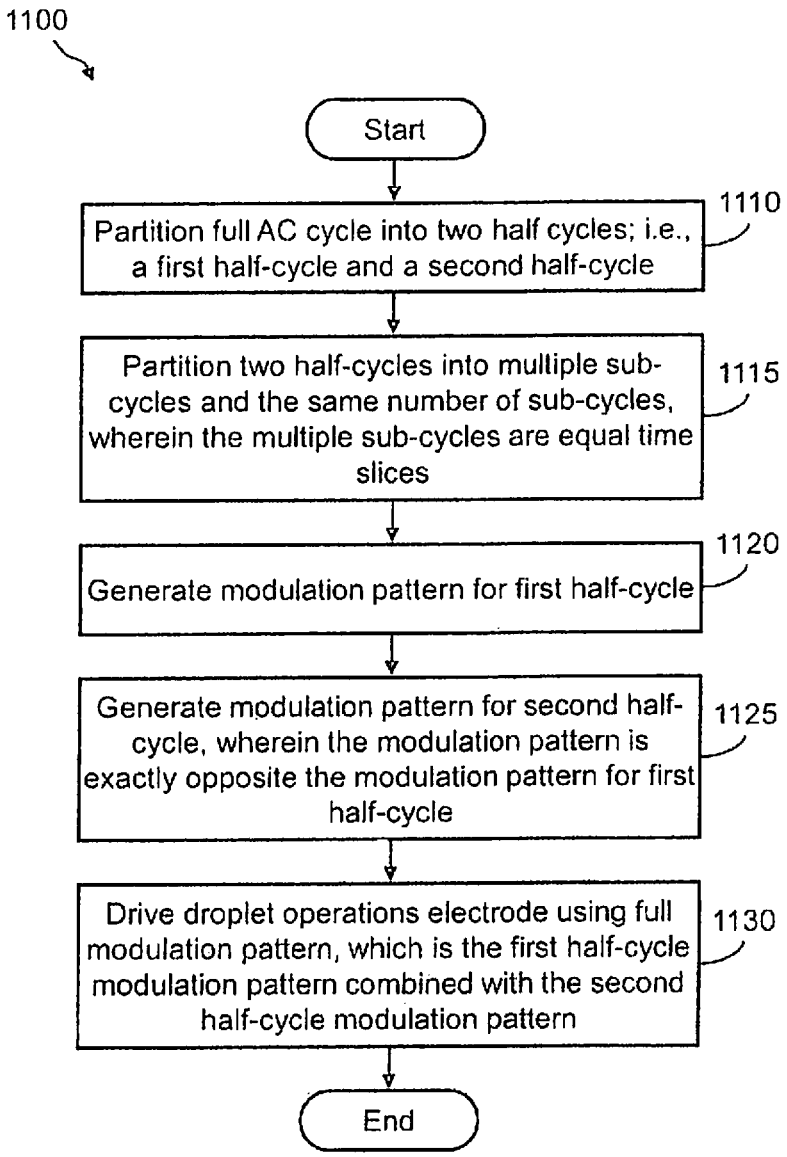
FIG. 11 illustrates a flow diagram of an example of a method of providing balanced AC modulation for driving droplet operations electrodes in accordance with embodiments herein.

FIG. 11 illustrates a flow diagram of an example of a method 1100 of providing balanced AC modulation for driving droplet operations electrodes. Method 1100 may include, but it not limited to, the following operations. The operations of FIG. 11 may be carried out by one or more processors (1340 in FIG. 13) or the controller 1230 in FIG. 12.

As explained herein, the method conducts droplet operations with a droplet actuator device having a substrate that defines a device channel to conduct droplet operations, having electrodes arranged on the substrate, and a drive circuit connected to the electrodes. The method generates an electrode drive signal based on a reference waveform, partitions the electrode drive signal into one or more AC modulated drive cycles formed of sub-cycles; and modulates the electrode drive signal with respect to the reference waveform, during the sub-cycles, by switching between at least first and second states. The switching is performed based on a degree of modulation with respect to the reference waveform that forms a balanced modulation pattern.

At 1110, the full AC cycle is partitioned into two half cycles; namely, a first half-cycle and a second half-cycle. Examples of which are shown and described in FIG. 3 through FIG. 7, FIG. 9, and FIG. 10.

At 1115, the two half-cycles are partitioned into multiple sub-cycles and the same number of sub-cycles, wherein the multiple sub-cycles are equal time slices. In one example, the first half-cycle is partitioned into four sub-cycles. Likewise, the second half-cycle is partitioned into four sub-cycles, making a total of eight sub-cycles in the full AC cycle. Examples of sub-cycles are shown and described in, FIG. 3 through FIG. 7. In another example, the first half-cycle is partitioned into eight sub-cycles. Likewise, the second half-cycle is partitioned into eight sub-cycles, making a total of sixteen sub-cycles in the full AC cycle, an example of which is shown and described in FIGS. 9 and 10. Hence, in accordance with the operations at 1110 and 1115, the method partitions a full AC cycle into a first half cycle and a second half cycle and partitioning each of the first and second half cycles into a common number of sub-cycles, the sub-cycles having equal timeslots.

At 1120 and 1125, modulating operations are performed in which the electrode drive signal is modulated with respect to the reference waveform in connection with the sub-cycles by switching between at least first and second states, where a degree of modulation with respect to the reference waveform maintains a balanced modulation pattern. For example, at 1120, a modulation pattern is generated for the first half-cycle of the full AC cycle. For example and referring now to FIG. 4, a modulation pattern for 25% phase modulation is generated for first half-cycle 310 of AC modulated drive cycle 300. For example, the 4-bit modulation pattern of control input 110 is set to "1000."

At 1125, a modulation pattern is generated for the second half-cycle of the full AC cycle, wherein the second half-cycle modulation pattern is the opposite of the first half-cycle modulation pattern that was generated at 1120. That is, in this step the first half-cycle modulation pattern that was generated at step 1120 is inverted to generate the second half-cycle modulation pattern. For example and referring now again to FIG. 4, which is a modulation pattern for 25% phase modulation, if the 4-bit modulation pattern of control input 110 for first half-cycle 310 is set at 1120 to "1000," then the 4-bit modulation pattern of control input 110 for second half-cycle 315 is set to "0111."

Optionally, the modulating operation includes phase shifting and/or pulse modulation of the electrode drive signal, with respect to the reference waveform, to achieve a desired degree of modulation. For example, the degree of modulation may be between 20% and 75% modulation with respect to the reference waveform. Optionally, the degree of modulation may be at least 25% modulation with respect to the reference waveform, or approximately 50% modulation. The modulation operations at 1120 and 1125 may switch between at least first/high and second/low state (e.g. voltage) (and optionally to a floating state/voltage) based on a multi-bit modulation pattern stored within a corresponding drive cycle 1344 (FIG. 13) which defines a balanced modulation pattern.

At 1130, the droplet operations electrode is driven using the first and second modulation patterns combined to form a full modulation pattern. For example, at 1130, the droplet operations electrode is driven using the full modulation pattern, which is the first half-cycle modulation pattern combined with the second half-cycle modulation pattern. Examples of modulation patterns are shown and described in FIG. 3 through FIG. 7, FIG. 9, and FIG. 10. For example and referring now again to FIG. 4, the droplet operations electrode is driven using the full modulation pattern of "1000_0111," which generates electrode drive signal 345.

In method 1100 of FIG. 11, it should be noted that while, in one embodiment, the method utilizes an exact opposite pattern in the second half-cycle as that in the first half-cycle, it is not absolutely necessary to utilize exact opposite patterns. Namely, the patterns do not have to be exactly opposite, such as when the ratio of high-time to low-time in the first half-cycle is generally the same as the ratio of the low-time to high-time in the second half-cycle. In so doing, the average voltage in each half-cycle will be approximately opposite.

In a microfluidics system, the electrowetting voltage (+HV) is a power supply voltage that is common to all electrodes in a fluidics cartridge. Namely, a multi-channel driver device powered by the electrowetting voltage (+HV) can be used to drive multiple channels. Drive circuit 100 of FIG. 1 and/or drive circuit 800 of FIG. 8 can be applied to each of the outputs of the driver. In so doing, using drive circuit 100 of FIG. 1 and/or drive circuit 800 of FIG. 8 and method 1100 of FIG. 11, the electrodes can be AC modulated in different ways at different times to achieve individual control of electrodes in the fluidics cartridge. Namely, the balanced AC modulation/timing schemes as described herein applied to each electrode enables different average voltages on each electrode.

FIG. 12 illustrates a functional block diagram of an example of a microfluidics system 1200 that includes a droplet actuator 1205, which is one example of a fluidics cartridge. Digital microfluidic technology conducts droplet operations on discrete droplets in a droplet actuator, such as droplet actuator 1205, by electrical control of their surface tension (electrowetting). The droplets may be sandwiched between two substrates of droplet actuator 1205, a bottom substrate and a top substrate separated by a droplet operations gap. The bottom substrate may include an arrangement of electrically addressable electrodes. The top substrate may include a reference electrode plane made, for example, from conductive ink or indium tin oxide (ITO). The bottom substrate and the top substrate may be coated with a hydrophobic material. Droplet operations are conducted in the droplet operations gap. The space around the droplets (i.e., the gap between bottom and top substrates) may be filled with an immiscible inert fluid, such as silicone oil, to prevent evaporation of the droplets and to facilitate their transport within the device. Other droplet operations may be effected by varying the patterns of voltage activation; examples include merging, splitting, mixing, and dispensing of droplets.

Droplet actuator 1205 may be designed to fit onto an instrument deck (not shown) of microfluidics system 1200. The instrument deck may hold droplet actuator 1205 and house other droplet actuator features, such as, but not limited to, one or more magnets and one or more heating devices. For example, the instrument deck may house one or more magnets 1210, which may be permanent magnets. Optionally, the instrument deck may house one or more electromagnets 1215. Magnets 1210 and/or electromagnets 1215 are positioned in relation to droplet actuator 1205 for immobilization of magnetically responsive beads. Optionally, the positions of magnets 1210 and/or electromagnets 1215 may be controlled by a motor 1220. Additionally, the instrument deck may house one or more heating devices 1225 for controlling the temperature within, for example, certain reaction and/or washing zones of droplet actuator 1205. In one example, heating devices 1225 may be heater bars that are positioned in relation to droplet actuator 1205 for providing thermal control thereof.

A controller 1230 of microfluidics system 1200 is electrically coupled to various hardware components of the apparatus set forth herein, such as droplet actuator 1205, electromagnets 1215, motor 1220, and heating devices 1225, as well as to a detector 1235, an impedance sensing system 1240, and any other input and/or output devices (not shown). Controller 1230 controls the overall operation of microfluidics system 1200. Controller 1230 may, for example, be a general purpose computer, special purpose computer, personal computer, or other programmable data processing apparatus. Controller 1230 serves to provide processing capabilities, such as storing, interpreting, and/or executing software instructions, as well as controlling the overall operation of the system. Controller 1230 may be configured and programmed to control data and/or power aspects of these devices. For example, in one aspect, with respect to droplet actuator 1205, controller 1230 controls droplet manipulation by activating/deactivating electrodes as explained herein in connection with FIGS. 1-11.

In one example, detector 1235 may be an imaging system that is positioned in relation to droplet actuator 1205. In one example, the imaging system may include one or more light-emitting diodes (LEDs) (i.e., an illumination source) and a digital image capture device, such as a charge-coupled device (CCD) camera. Detection can be carried out using an apparatus suited to a particular reagent or label in use. For example, an optical detector such as a fluorescence detector, absorbance detector, luminescence detector or the like can be used to detect appropriate optical labels. Systems designed for array-based detection are particularly useful. For example, optical systems for use with the methods set forth herein may be constructed to include various components and assemblies as described in Banerjee et al., U.S. Pat. No. 8,241,573, entitled "Systems and Devices for Sequence by Synthesis Analysis," issued on Aug. 14, 2012; Feng et al., U.S. Pat. No. 7,329,860, entitled "Confocal Imaging Methods and Apparatus," issued on Feb. 12, 2008; Feng et al., U.S. Pat. No. 8,039,817, entitled "Compensator for Multiple Surface Imaging," issued on Oct. 18, 2011; Feng et al., U.S. Patent Pub. No. 20090272914, entitled "Compensator for Multiple Surface Imaging," published on Nov. 5, 2009; and Reed et al., U.S. Patent Pub. No. 20120270305, entitled "Systems, Methods, and Apparatuses to Image a Sample for Biological or Chemical Analysis," published on Oct. 25, 2012, the entire disclosures of which are incorporated herein by reference. Such detection systems are particularly useful for nucleic acid sequencing embodiments.

Impedance sensing system 1240 may be any circuitry for detecting impedance at a specific electrode of droplet actuator 1205. In one example, impedance sensing system 1240 may be an impedance spectrometer. Impedance sensing system 1240 may be used to monitor the capacitive loading of any electrode, such as any droplet operations electrode, with or without a droplet thereon. For examples of suitable capacitance detection techniques, see Sturmer et al., International Patent Pub. No. WO/2008/101194, entitled "Capacitance Detection in a Droplet Actuator," published on Dec. 30, 2009; and Kale et al., International Patent Pub. No. WO/2002/080822, entitled "System and Method for Dispensing Liquids," published on Feb. 26, 2004, the entire disclosures of which are incorporated herein by reference.

Droplet actuator 1205 may include disruption device 1245. Disruption device 1245 may include any device that promotes disruption (lysis) of materials, such as tissues, cells and spores in a droplet actuator. Disruption device 1245 may, for example, be a sonication mechanism, a heating mechanism, a mechanical shearing mechanism, a bead beating mechanism, physical features incorporated into the droplet actuator 1205, an electric field generating mechanism, armal cycling mechanism, and any combinations thereof. Disruption device 1245 may be controlled by controller 1230.

FIG. 13 illustrates a cross-section of a portion of a droplet actuator device 1300 that utilizes drive circuits in accordance with embodiments herein. The droplet actuator device 1300 may represent a fluidics cartridge integrated into a standalone unit, or alternatively represent a fluidics cartridge coupled to additional components, such as drive circuits and one or more processors. The droplet actuator device 1300 may be or include a digital fluidic device or droplet actuator in some embodiments. The droplet actuator device 1300 include one or more drive circuits 1346 which may resemble the drive circuit 100 of FIG. 1 and/or the drive circuit 800 of FIG. 8. The drive circuits 1346 are coupled to and controlled by one or more processors 1340. The one or more processors 1340 may be in addition to, or form part of, the controller 1230 in FIG. 12. The processor 1340 is coupled to memory 1342 which includes programmable instructions to direct the processor 1342 to perform various operations, such as, but not limited to, managing the drive circuits to generate electrode drive signals in accordance with embodiments herein. For example, the memory 1342 stores one or more drive cycles 1344 corresponding to the AC modulated drive cycles described in connection with FIGS. 3-7 and 9-10. The memory 1342 may store program instructions to direct the processor 1340 to carry out the operations described in connection with FIG. 11. The memory 1342 stores programmable instructions and the processor 1340 executes the programmable instructions to generate a control input (e.g., control inputs 110, 810) and an enable input 812 that are delivered to the drive circuit 1346. The drive cycles 1344 are defined by predetermined modulation patterns (e.g., the bit modulation patterns in FIGS. 3-7 and 9-10) that are utilized in connection with associated electrodes during droplet operations. Certain drive cycles 1344 may be associated with corresponding electrodes. Additionally or alternatively, one or more common drive cycles 1344 may be used with all electrodes or a subset of the total number of electrodes. As a further example, various drive cycles 1344 may be repeated over and over, and/or may be associated with particular types of droplet operations. For example, a first drive cycle may be applied to multiple electrodes to advance a droplet along a channel, while a second drive cycle is used to split a droplet or hold a droplet at a select location.

The droplet actuator device 1300 also includes a housing 1302 that is configured to hold a filler fluid 1304 (e.g., oil) and one or more solutions 1306 (e.g., reagent or sample solutions). The housing 1302 may be formed from multiple components. For example, the housing 1302 includes a top or cover substrate 1308 and a bottom substrate 1310. The top substrate 1308 is mounted to the bottom substrate 1310. The top and bottom substrates 1308, 1310 are separated by an operational gap that defines a device channel 1312. The top substrate 1308 has an opening 1313. When the top substrate 1308 is mounted to the bottom substrate 1310, the top and bottom substrates 1308, 1310 form a receiving cavity 1314 that is accessible through the opening 1313. The receiving cavity 1314 is sized and shaped to hold a volume 1316 of the solution 1306 and is configured to receive the solution 1306 from an assay reservoir 1324.

Optionally, the droplet actuator device 1300 may be constructed from various substrate architectures, such as coplanar architectures, bi-planar architectures and the like. The droplet actuator device 1300 may be constructed using various shapes, such as (but not limited to) square, rectangular, oval, circular, triangular, polyhedral and the like. The electrodes 1320 are arranged adjacent to one another in a desired pattern. For example, the electrodes 1320 may be arranged in an array having one or more rows and/or columns. Alternative patterns of electrodes 1320 may be utilized depending upon the droplet operations of interest, the shape of the device channel 1312, as well as other design considerations.

Optionally, droplet actuator device 1300 may be constructed utilizing fewer or more than a top and bottom substrate. For example, the droplet actuator device 1300 constructed using a single substrate with a top surface and a bottom surface. The single substrate would be formed to include the device channel 1312 and opening 1313 therein. Optionally, the droplet actuator device 1300 may be formed with an open sided substrate, such as by utilizing the bottom substrate 1310 and removing the top substrate 1308, thereby providing the device channel 1312 uncovered. One example of a structure that may afford an open sided substrate may represent a printed circuit board, into which open sided device channels are formed.

Optionally, an insulation layer may be provided to cover the electrodes 1320 in order to electrically isolate the droplets 1318 from the electrodes 1320. Optionally, a thin line of conductive material may be provided within the device channel 1312 and positioned on the droplet side of the insulation layer. The conductive material may be electrically connected to the reference voltage in order to couple the droplets to the reference voltage. For example, the line of conductive material may extend along the device channel 1312 and be positioned to align with centers of the electrodes 1320. Given that the line of conductive material is tied to the reference voltage and is in contact with the droplet 1318, the droplet 1318 and a correspondingly aligned electrode 1320 effectively becomes opposite plates of a virtual parallel capacitor. A potential difference is maintained between the reference voltage (as applied to the droplet 1318) and the electrode 1320 which creates an electric field between the droplet 1318 and the electrode 1320. The electric field between the droplet 1318 electrode 1320 cause the droplet 1318 to generally "flatten out" above the electrode 1320, thereby increasing an area through which the electric field passes between the droplet 1318 and electrode 1320.

Optionally, the droplet actuator device 1300 may be constructed utilizing a bi-planar architecture such as one that includes a bottom substrate (e.g. a printed circuit board containing active electrodes) and a top plate covering the device channels 1312. The top plate may include a PDOT coating, where the top plate is in electrical contact with the droplet 1318 and is electrically connected to the reference voltage.

In accordance with at least some embodiments, a drive voltage may be applied across two or more adjacent electrodes 1320, such as to create an electric field having a desired strength between the corresponding adjacent electrodes 1320. The droplet 1318 is then "pulled" into the region between the adjacent electrodes 1320 forming the electric field, thereby providing a path of lower resistance for the electric field (through the droplet).

In the foregoing embodiments, the droplets 1318 are generally driven to the reference voltage, while the opposed electrode/electrodes are driven by the AC modulated drive cycles described in connection with the figures. The electrowetting operation generally involves producing an electric field that is applied across the droplets 1318. The electric field is produced between two or more electrodes that are located near (and possibly in contact with) a droplet of interest. In a bi-planar architecture, the second electrode of the pair that creates the electric field represents the top plate that is driven by the reference voltage and is in contact with the droplet 1318 (thereby maintaining the droplets at the reference voltage). The droplets then become attracted to the opposed electrode at a different voltage (as determined by the electrode to drive signal and AC modulated drive cycle). The voltage difference between the reference voltage and the voltage of the electrode drive signal causes the attraction by the droplet to the next electrode.

In a coplanar architecture, the droplets are not in direct electrical contact with any electrodes. Instead, each electrode that is in the "off" state is effectively driven by the reference waveform/voltage, while each electrode that is in the "on" state is driven by the electrode drive signal. In the coplanar architecture, droplets have a tendency to "flatten out" over multiple electrodes, such as an "on" electrode and one or more adjacent "off" electrodes that are driven by the reference voltage. The foregoing represents one example of the electrical behavior that may be utilized to conduct droplet operations.

As shown, droplets 1318 may be formed from the larger volume 1316 within the receiving cavity 1314 and transported through the device channel 1312. To this end, the housing 1302 may include an arrangement of electrodes 1320 that are positioned along the device channel 1312. For instance, the bottom substrate 1310 includes a series of the electrodes 1320 positioned along the device channel 1312. The top substrate 1310 may include a reference electrode (not shown). Alternatively, the bottom substrate 1310 may include a reference electrode. The bottom substrate 1310 may also include a reservoir electrode 1322. The reservoir electrode 1322 may be utilized by the system controller to hold the larger volume 1316. The electrodes 1320, 1322 are electrically coupled to one or more drive circuit 1346 that are controlled by the processor 1340 (or another system controller (not shown)). In accordance with embodiments herein, the top substrate 1308 and bottom substrate 1310, electrodes 1320, 1322 and drive circuit 1346 are housed within a common housing forming a fluidics cartridge.

The processor 1340 is configured to control voltages of the electrodes 1320, 1322 to conduct electrowetting operations by adjusting the control input (e.g. 110 in FIG. 1 or 810 in FIG. 8) as explained herein. More specifically, the electrodes 1320, 1322 may be activated/deactivated (utilizing one or more of the AC modulation drive cycles described herein) to form droplets 1318 from the larger volume 1316 and move the droplets 1318 away from the receiving cavity 1314 through the device channel 1312. For example, various drive cycles 1344 may be utilized to modulate the electrode drive signals delivered to select electrodes 1320, 1322 to form the droplets 1318 and then move the droplets 1318 through the device channel 1312.

As explained herein, the drive circuits 1346 generate corresponding electrode drive signals to carry out select droplet operations. The drive circuit 1346 generates the electrode drive signals to drive the droplet operations based on a reference waveform. The electrode drive signals are partitioned into corresponding AC modulated drive cycles formed of sub-cycles. In accordance with embodiments herein, the electrode drive signals switch, in connection with (e.g., during) the sub-cycles, between at least first and second states (e.g. high and low states, and optionally a floating state). The electrode drive signal may switch states at a beginning, end and/or at intermediate points with one or more sub-cycles. The electrode drive signals are switched between desired states to achieve a degree of modulation with respect to the reference waveform that forms and maintains a balanced modulation pattern.

As explained herein, the drive circuits 1346 (at the direction of the processor 1340) partition one or more AC modulated drive cycles into first and second half cycles, corresponding to the sub-cycles, where the first half cycle has a first modulation pattern that is an opposite of a second modulation pattern of the second half cycle. Optionally, the drive circuit 1346 utilizes at least one of phase modulation or pulse modulation during the AC modulated drive cycle to maintain a substantially zero DC bias. Optionally, the drive circuit 1346 may utilize tri-state modulation (as explained in connection with FIGS. 8-10) to partition the AC modulated drive cycle, where the tri-state modulation switches between the first and second states and a floating state.

The drive circuit 1346 generates the electrode drive signal based on the control input 110, 810 (and the enable input 812 for a tri-state drive circuit 800). Optionally, the processor 1340 also generates the enable input 812 (FIG. 8). The processor 1340 utilizes the control input 110, 810 to direct the drive circuit 1346 to modulate the electrode drive signal with respect to the reference waveform to form the balanced modulation pattern. The processor 1340 divides the sub-cycles into timeslots and directs the drive circuit(s) 1346 to switch the electrode drive signal(s) to have one of the first and second states that differs from the reference waveform during at least a portion of the timeslots. The processor 1340 directs the drive circuit(s) 1346 to increase a frequency of the electrode drive signal(s), with respect to the reference waveform, through pulse modulation.

Alternatively or in addition to holding the larger volume 1316, the reservoir electrode 1322 may be utilized to detect a volume of the volume 1316. More specifically, the electrode 1322 may communicate information that may be used to determine the volume 1316. If the volume 1316 is determined to be insufficient, the system controller may activate a mechanism that is configured to load or re-load the receiving cavity 1314 with the solution from the assay reservoir 1324. For example, one or more of the embodiments described herein may be used to load the receiving cavity 1314 with the solution 1316. The solution 1316 may be actively or passively provided into the receiving cavity 1314.

Optionally, the drive circuit(s) 1346 may drive the reference electrode and the drive electrode to opposite high and low states (positive and negative voltages) to generate a voltage potential there between that is double the peak voltage of a voltage source. For example, a voltage source may have a peak voltage (HV) of 300V. However, the drive circuit(s) 1346 may drive the reference electrode to a negative peak voltage (e.g., −300V), while the same or a different drive circuit(s) 1346 drives the drive electrode to a positive peak voltage (e.g., +300V), thereby achieving a voltage potential there between that is double the peak voltage of the voltage source.

Figure 14:
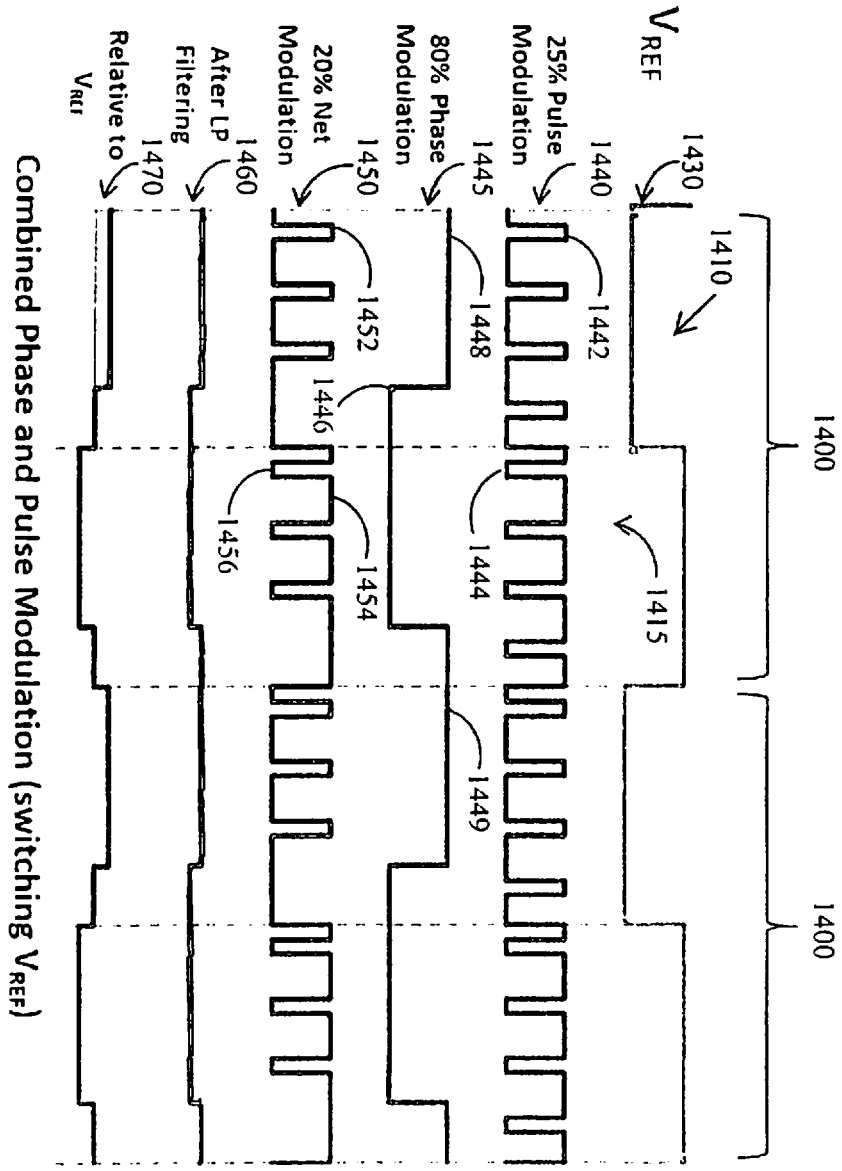
FIG. 14 illustrates an example of an AC modulated drive cycle implemented by the drive circuit of FIG. 1, where the AC modulated drive cycle uses both phase modulation and pulse modulation superimposed upon one another to provide balanced AC modulation in accordance with embodiments herein.

FIG. 14 illustrates an example of an AC modulated drive cycle 1400 implemented by the drive circuit 100 of FIG. 1, where the AC modulated drive cycle 1400 uses both phase modulation and pulse modulation superimposed upon one another to provide balanced AC modulation in accordance with embodiments herein. In FIG. 14, a reference waveform 1430 is applied to a reference electrode located near or in contact with the droplet being manipulated. In FIG. 14, the first AC modulated drive cycle 1400 is formed of two half cycles, namely a first-half cycle 1410 and a second half cycle 1415.

FIG. 14 shows a first electrode drive signal 1440 that is pulse modulated and a second electrode drive signal 1445 that is phase modulated. The first electrode drive signal 1440 utilizes a select level of pulse modulation, such as but not limited to 25% pulse modulation. The first electrode drive signal 1440 exhibits a polarity opposite to the polarity of the reference waveform 1430 for the select percentage of each half cycle 1410, 1450. For example, the first electrode drive signal 1440 exhibits a series of pulses 1442 that have a desired pulse width, where the sum of the pulse widths of (or areas within) the pulses 1442 corresponds to a select percentage (e.g. 25%) of the pulse width of (or area within) the pulse modulation of the first half cycle 1410. During the remainder of the first half cycle 1410, the first electrode drive signal 1440 maintains a polarity that is common to the polarity of the reference waveform 1430 (e.g. a low state).

When the polarity of the reference waveform 1430 changes (e.g. to a high state) during the second half cycle 1415, the first electrode drive signal 1440 similarly changes state in order that pulses 1444 exhibit a polarity (e.g. low state) opposite to the polarity of the reference waveform 1430 during the second half cycle. The pulses 1444 have a pulse width (or area within the pulse) that collectively equals 25% of the duration of the pulse width of (or area within) the reference waveform 1430 during the second half cycle 1415. During the remaining 25% of the second half cycle 1415, the first drive signal-1440 maintains a polarity (e.g. high state) that corresponds to the polarity of the reference waveform 1430.

The second electrode drive signal 1445 utilizes a select level of phase modulation, such as but not limited to, 80% phase modulation. The second electrode drive signal 1445 maintains a waveform shape corresponding to the shape of the reference waveform 1430, but phase shifted by a select amount such that the second electrode drive signal 1445 maintains a polarity opposite to the polarity of the reference waveform 1430 for the select percentage of the cycle. In the example of FIG. 14, the second electrode drive signal 1445 exhibits 80% phase modulation such that 80% of the second electrode drive signal 1445 exhibits a polarity opposite to the polarity of the reference waveform 1430 during each individual half cycle. For example, the second electrode drive signal 1445 maintains a high state 1448 for approximately 80% of the first half drive cycle 1410, while the reference waveform 1430 maintains a low state during the entire first half cycle 1410. The second electrode drive signal 1445 maintains a low state 1446 for approximately 20% of the first half drive cycle 1410.

When the polarity of the reference waveform 1430 changes state during the second half cycle 1415, the second electrode drive signal 1445 maintains the prior low state 1446 for a select period of time, such as for 80% of the duration of the second half cycle 1415. Thereafter, the second drive signal 1445 changes to the high state which corresponds to the state of the reference waveform 1430.

It is recognized that alternative amounts of pulse and phase modulation may be provided in the first and second electrode drive signals 1440 and 1445.

The first and second electrode drive signals 1440 and 1445 are combined with one another to form a combined modulated drive signal 1450. The combined modulated drive signal 1450 represents the superposition of the first and second electrode drive signals 1440 and 1445 onto one another. The combined modulated drive signal 1450 includes pulses 1452 that correspond to the pulses 1442 in the first electrode drive signal 1440 that occur while the second electrode drive signal 1445 is in the same state (e.g. high state). When the second electrode drive signal 1445 changes to the low state 1446, the combined modulated drive signal 1450 does not produce a pulse corresponding to the last pulse in the first electrode drive signal 1440 during the first half cycle 1410.

During the second half cycle 1415, the combined modulated drive signal 1450 maintains a high state 1454 for a majority of the cycle, while dropping to a low state only during pulses 1456 that align with the first three pulses 1444 in the first electrode drive signal 1440. When the second electrode drive signal 1445 changes to the high state (at 1449), the combined modulated drive signal 1450 does not produce (omits) a pulse corresponding to the last pulse in the first electrode drive signal 1440 during the second half cycle 1415. In the present example, the combined modulated drive signal 1450 exhibits a net modulation of approximately 20%, although alternative amounts of modulation may be utilized.

The combined modulated drive signal 1450 may be formed utilizing various implementations. For example, the first and second electrode drive signals 1440 and 1445 may be both directly applied to a common electrode. Additionally or alternatively, the first and second electrode drive signals 1440 and 1445 may be applied to separate electrodes located adjacent to one another. Optionally, the first and second electrode drive signals 1440 and 1445 may be supplied as inputs to a circuit that performs superposition there between. For example, the circuit may include an AND gate or other circuit, the inputs to which correspond to the first and second electrode drive signals 1440 and 1445. The AND gate or other circuit perform signal superposition, the output therefrom may then be connected to one or more electrodes.

FIG. 14 also illustrates a low pass filtered signal 1460 which results when the combined modulated drive signal 1450 is low pass filtered by the system. The combined modulated drive signal 1450 experiences low pass filtering due in part to the internal filtering characteristics created by the system. For example, the high-voltage drive circuit may deliver the combined modulated drive signal 1450 from an output to a high impedance resistor (e.g. 1 Mega-ohm resistor). The output of the high impedance resistor is conveyed along a trace/line to one or more of the electrodes discussed herein. The line/trace, electrode and other components within the signal path exhibit a certain amount of parasitic capacitance that, when combined with the high impedance resistor, introduce a low pass filtering effect. For example, the low pass filtering effect may exhibit a time constant of approximately 1/RC, where R represents the resistance of the high impedance resistor and C represents the parasitic capacitance of the line/trace, electrode, etc. The low pass filter may have a time constant that is sufficiently lower than the modulation frequency of the combined modulated drive signal 1450 to average out the 20% modulation to a lower average voltage exhibited at the corresponding electrode. Hence, instead of experiencing sharp pulses that switch to a high state 20% of the time, the electrode experiences a smoother voltage transition that is averaged over the first 80% of the half cycle.

Optionally, the time constant of the low pass filtering effect may be modified by changing the resistance of the high impedance resistor and/or adding additional capacitor(s) to the line.

FIG. 14 also illustrates a voltage difference 1470 that is experienced across droplets, where the voltage difference 1470 corresponds to the difference between the reference waveform 1430 and the low pass filtered signal 1460.

Optionally, the reference waveform 1430 may be omitted utilizing other waveform patterns, as well as a straight line DC voltage, a zero reference voltage and the like. The first and second electrode drive signals 1440 and 1445 would be modified accordingly to achieve the desired amount of pulse modulation and phase modulation relative to the different reference waveform.

Figure 15:
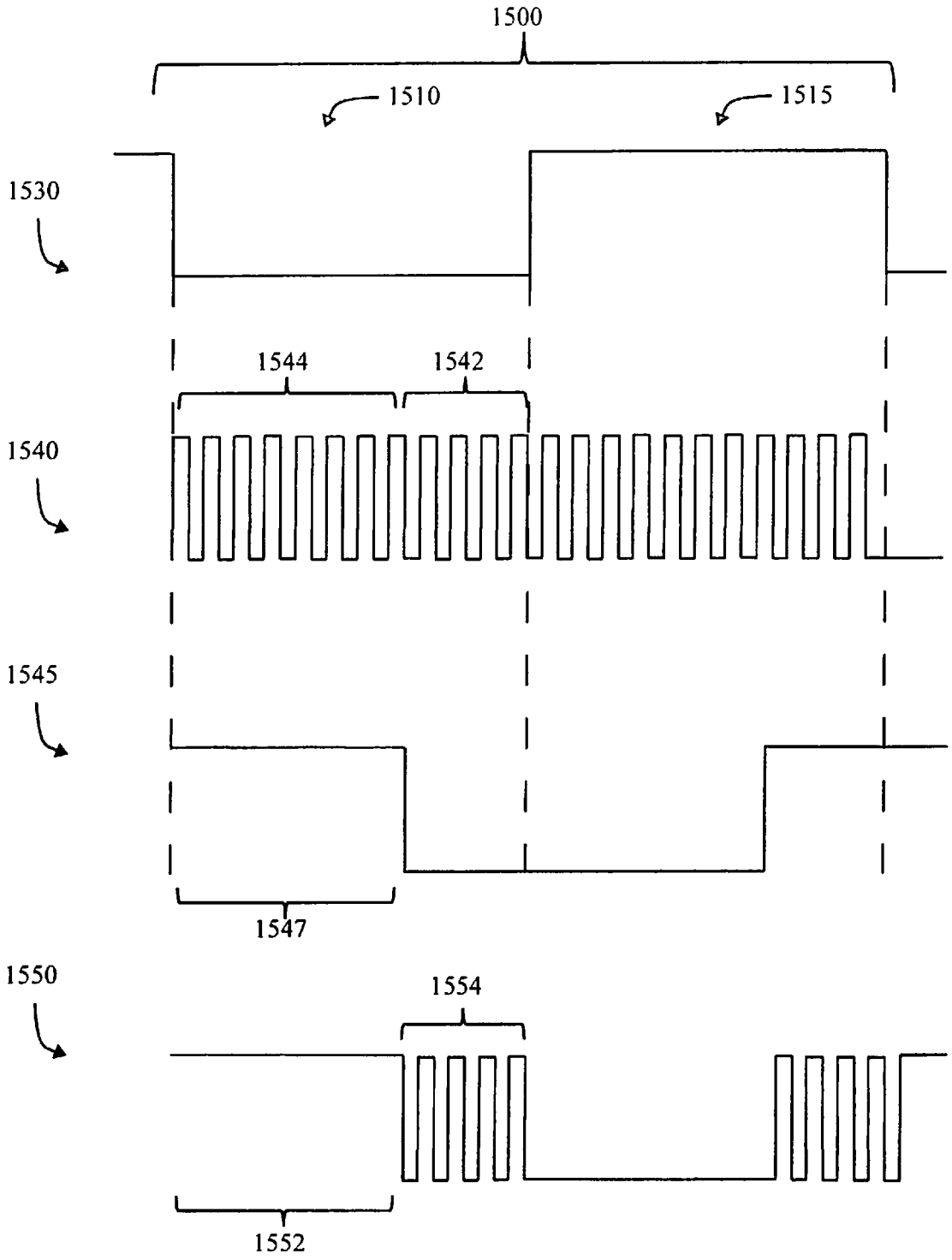
FIG. 15 illustrates an example of an AC modulated drive signal implemented by the drive circuit of FIG. 1, where the AC modulated drive cycle uses both phase modulation and pulse modulation, but with the phase and pulse modulation separated temporally in time from one another and provided at different portions of half cycles and in accordance with embodiments herein.

FIG. 15 illustrates an example of an AC modulated drive signal 1500 implemented by the drive circuit 100 of FIG. 1, where the AC modulated drive cycle 1500 uses both phase modulation and pulse modulation, but with the phase and pulse modulation separated temporally in time from one another and provided at different portions of half cycles 1510 and 1515 in accordance with embodiments herein. In FIG. 15, a reference waveform 1530 is applied to a reference electrode located near or in contact with the droplet being manipulated. In FIG. 15, the first AC modulated drive cycle 1500 is formed of two half cycles, namely a first-half cycle 1510 and a second half cycle 1515.

In FIG. 15, the first electrode drive signal 1540 is pulse modulated, while the second electrode drive signal 1545 is phase modulated. However, the embodiment of FIG. 15 differs from the embodiment of FIG. 14 in that a resulting signal 1550 is generated with a first portion 1552 that corresponds to the phase modulated portion 1547 of the second electrode drive signal 1545. Thereafter, the second electrode drive signal 1545 is disconnected and the first electrode drive signal 1540 is connected, such that a final portion 1554 of the resulting signal 1550 matches the phase modulated portion 1542 of the first electrode drive signal.

In the example of FIG. 15, the first electrode drive signal 1530 exhibits a very high modulation frequency throughout both have cycles 1510 and 1550. However, a first portion 1544 is not joined to or provided within the resulting signal 1550. Instead, the final portion 1542 of the first electrode drive signal 1540 is utilized in the resulting signal 1550. Optionally, the modulation frequency may be high, medium or low.

It will be appreciated that various aspects of the present disclosure may be embodied as a method, system, computer readable medium, and/or computer program product. Aspects of the present disclosure may take the form of hardware embodiments, software embodiments (including firmware, resident software, micro-code, etc.), or embodiments combining software and hardware aspects that may all generally be referred to herein as a "circuit," "module," or "system." Furthermore, the methods of the present disclosure may take the form of a computer program product on a computer-usable storage medium having computer-usable program code embodied in the medium.

Any suitable computer useable medium may be utilized for software aspects of the present disclosure. The computer-usable or computer-readable medium may be, for example but not limited to, an electronic, magnetic, optical, electromagnetic, infrared, or semiconductor system, apparatus, device, or propagation medium. The computer readable medium may include transitory and/or non-transitory embodiments. More specific examples (a non-exhaustive list) of the computer-readable medium would include some or all of the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission medium such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Program code for carrying out operations of the methods and apparatus set forth herein may be written in an object oriented programming language such as Java, Smalltalk, C++ or the like. However, the program code for carrying out operations of the methods and apparatus set forth herein may also be written in conventional procedural programming languages, such as the "C" programming language or similar programming languages. The program code may be executed by a processor, application specific integrated circuit (ASIC), or other component that executes the program code. The program code may be simply referred to as a software application that is stored in memory (such as the computer readable medium discussed above). The program code may cause the processor (or any processor-controlled device) to produce a graphical user interface ("GUI"). The graphical user interface may be visually produced on a display device, yet the graphical user interface may also have audible features. The program code, however, may operate in any processor-controlled device, such as a computer, server, personal digital assistant, phone, television, or any processor-controlled device utilizing the processor and/or a digital signal processor.

The program code may locally and/or remotely execute. The program code, for example, may be entirely or partially stored in local memory of the processor-controlled device. The program code, however, may also be at least partially remotely stored, accessed, and downloaded to the processor-controlled device. A user's computer, for example, may entirely execute the program code or only partly execute the program code. The program code may be a stand-alone software package that is at least partly on the user's computer and/or partly executed on a remote computer or entirely on a remote computer or server. In the latter scenario, the remote computer may be connected to the user's computer through a communications network.

The methods and apparatus set forth herein may be applied regardless of networking environment. The communications network may be a cable network operating in the radio-frequency domain and/or the Internet Protocol (IP) domain. The communications network, however, may also include a distributed computing network, such as the Internet (sometimes alternatively known as the "World Wide Web"), an intranet, a local-area network (LAN), and/or a wide-area network (WAN). The communications network may include coaxial cables, copper wires, fiber optic lines, and/or hybrid-coaxial lines. The communications network may even include wireless portions utilizing any portion of the electromagnetic spectrum and any signaling standard (such as the IEEE 802 family of standards, GSM/CDMA/TDMA or any cellular standard, and/or the ISM band). The communications network may even include powerline portions, in which signals are communicated via electrical wiring. The methods and apparatus set forth herein may be applied to any wireless/wireline communications network, regardless of physical componentry, physical configuration, or communications standard(s).

Certain aspects of present disclosure are described with reference to various methods and method steps. It will be understood that each method step can be implemented by the program code and/or by machine instructions. The program code and/or the machine instructions may create means for implementing the functions/acts specified in the methods.

The program code may also be stored in a computer-readable memory that can direct the processor, computer, or other programmable data processing apparatus to function in a particular manner, such that the program code stored in the computer-readable memory produce or transform an article of manufacture including instruction means which implement various aspects of the method steps.

The program code may also be loaded onto a computer or other programmable data processing apparatus to cause a series of operational steps to be performed to produce a processor/computer implemented process such that the program code provides steps for implementing various functions/acts specified in the methods of the present disclosure.

The foregoing detailed description of embodiments refers to the accompanying drawings, which illustrate specific embodiments of the present disclosure. Other embodiments having different structures and operations do not depart from the scope of the present disclosure. The term "the invention" or the like is used with reference to certain specific examples of the many alternative aspects or embodiments of the applicants' invention set forth in this specification, and neither its use nor its absence is intended to limit the scope of the applicants' invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation.

What is claimed is:

1. A method for conducting droplet operations with a droplet actuator device having a top substrate and a bottom substrate that defines a device channel to conduct droplet operations, having electrodes arranged on at least one of the top and bottom substrate, and a drive circuit connected to the electrodes, the method comprising:

generating an electrode drive signal based on a reference waveform;

partitioning the electrode drive signal into an AC modulated drive cycle formed of sub-cycles;

generating first and second modulation patterns for first and second sub-cycles, respectively, the first modulation pattern being an opposite of the second modulation pattern; and modulating the electrode drive signal with respect to the reference waveform, in connection with the sub-cycles, by switching between at least first and second states, where a degree of modulation with respect to the reference waveform forms a balanced modulation pattern.

2. The method of claim 1, wherein the partitioning includes partitioning a full AC cycle into a first half cycle and a second half cycle and partitioning each of the first and second half cycles into a common number of sub-cycles, the sub-cycles having equal timeslots.

3. The method of claim 1, further comprising driving a corresponding electrode using the first and second modulation patterns combined to form a full modulation pattern.

4. The method of claim 1, wherein the modulating operation includes phase shifting the electrode drive signal, with respect to the reference waveform, to achieve at least 25% modulation with respect to the reference waveform.

5. The method of claim 1, wherein the modulation operation switches between at least a first voltage and a second voltage based on a multi-bit modulation pattern defining the balanced modulation pattern.

6. The method of claim 1, wherein the modulating operation includes switching the electrode drive signal, during each of the sub-cycles, between a high state, a low state and a floating state, the high and low states corresponding to the first and second states.

* * * * *